US006692416B1

(12) United States Patent
Davis

(10) Patent No.: US 6,692,416 B1
(45) Date of Patent: Feb. 17, 2004

(54) EXERCISE MACHINE HANDLES

(75) Inventor: James O. Davis, Oceanside, CA (US)

(73) Assignee: Magnascope, Inc., San Diego, CA (US)

( * ) Notice: Subject to any disclaimer, the term of this patent is extended or adjusted under 35 U.S.C. 154(b) by 96 days.

(21) Appl. No.: 10/123,973

(22) Filed: Apr. 16, 2002

(51) Int. Cl.[7] ..... A63B 21/00
(52) U.S. Cl. ..... 482/139; 482/44
(58) Field of Search ..... 482/44–46, 92, 482/121, 133–137, 139; D21/662, 684

(56) References Cited

U.S. PATENT DOCUMENTS

| | | | | |
|---|---|---|---|---|
| D262,814 | S | | 1/1982 | Lambert, Jr. et al. |
| 4,869,492 | A | * | 9/1989 | Joutras ..... 482/44 |
| D317,032 | S | | 5/1991 | Eckler |
| D320,636 | S | | 10/1991 | Eckler |
| 5,076,578 | A | * | 12/1991 | Askonen ..... 482/139 |
| 5,102,122 | A | | 4/1992 | Piane, Jr. et al. |
| 5,842,961 | A | | 12/1998 | Davis |
| D404,094 | S | * | 1/1999 | Ho ..... D21/684 |

* cited by examiner

*Primary Examiner*—Glenn E. Richman
(74) *Attorney, Agent, or Firm*—Charles H. Thomas

(57) ABSTRACT

A pair of handles are provided for attachment to an exercising apparatus having at least one that cable that provides resistance to a force exerted on the cable. Each handle is formed of a handgrip of a size suitable for grasping in the hand of a user. Each handle also includes a single, solid, rigid rod bent to define a straight, cylindrical grip attachment portion that fits within the hand grip, a straight proximal portion that is inclined relative to the grip attachment portion at two angles, considered in two orthogonal planes of reference, both of which contain the axis of the grip attachment portion, an arcuately curved intermediate portion, and a straight, distal portion. An omnidirectional cable coupling is provided at the distal portion of the rod. The rods are formed in mirror image to each other, considered in the second reference plane. When utilized as a matched pair, the grips may be oriented in four basic different positions relative to each other for attachment to one or more cables of an exercise machine.

20 Claims, 25 Drawing Sheets

EXERCISE MACHINE HANDLES

BACKGROUND OF THE INVENTION

1. Field of the Invention

The present invention relates to handles that are connected by one or more cables to a force-resisting member of a body building, physical fitness or physical rehabilitation exercising machine.

2. Description of the Prior Art

Conventional body building machines are widely utilized for building and maintaining many different muscles of a person's body through physical exercise. Most of these exercise devices include one or more cables that are attached to weights, resiliently deflectable members, or other structures that offer resistence to the forces that a person exerts by pulling on the cable or cables.

One such exercise machine is described in my prior U.S. Pat. No. 5,842,961, which is hereby incorporated herein by reference in its entirety. In this and other exercise machines, one end of a cable or a plurality of cables is attached to a load to be overcome, and the other, free end is connected to some sort of handle that a user grips in his or her hand to exert a force to place the cable in tension, and thereby stress, exercise, and build up various muscles by pulling on the cable.

The handles employed in exerting tension on a cable of an exercise machine are quite important, since they affect the manner in which the muscles of a person's body are stressed in applying force on the cable or cables of an exercise machine. The handles should be configured so that the exercise machine may be utilized to exercise a different muscle groups in the body by applying forces to place the cable in tension in many different ways. While some handles are suitable for performing certain exercises, they are often inappropriate for performing other exercises, since they are configured in such a way as to cause the user pain or are merely ineffective in performing certain exercises.

In my prior U.S. Pat. No. 5,842,961 I disclosed an exercise machine handle that employs a hollow, tubular rod formed into a generally "J-shaped" configuration formed of a series of straight, linear segments and in which an eye-bolt is provided near the distal extremity of the tubular rod for coupling to the cable. While this handle is quite satisfactory for many exercises, I have since discovered that it has certain shortcomings. More specifically, I have discovered that the linear, segmented J-shaped handles of my prior U.S. Patent, when utilized to perform certain exercises, do not activate the muscles of the user as precisely as desired. Also, I have discovered that the utilization of these handles can cause pain to a user in the performance of certain exercises. In addition, I have discovered that the eye-bolts near the distal extremities of the tubular rods cause the S-shaped coupling links that are employed as connections to the cables can become bunched up between the handles and the cables to which they are attached and thereby distort the application of forces which certain exercises are designed to achieve.

SUMMARY OF THE INVENTION

The present invention provides a uniquely configured handle for an exercise machine that remedies the foregoing shortcomings of prior exercise machine handles and which is far more versatile than exercise machine handles that have heretofore existed. The exercise machine handle of the present invention has features that allow it to be utilized in a wide variety of different exercises without causing pain to the user and while consistently maintaining a straight, linear force on the exercise machine cable to which the handle is connected. A handle constructed according to the present invention may to be used with an exercise machine to successfully build and strengthen numerous muscles and muscle groups within the body without introducing pain or soreness. This has heretofore not been possible with other conventional exercise machine handles.

In one broad aspect the present invention may be considered to be a handle for use with a physical exercising machine that has a cable attached to a force-resisting element. The handle of the invention is comprised of a tubular handgrip of a length and circumference suitable for grasping by the hand of a user, a solid, rigid rod that is configured to form: a straight, cylindrical grip attachment portion mounted for rotation within the handgrip and constrained from longitudinal movement relative to the handgrip; a straight, proximal portion, located adjacent the grip attachment portion and oriented at a first acute angle of between about fifteen degrees and about forty-five degrees relative to the grip attachment portion, considered in a first plane of reference containing the grip attachment portion, and oriented at a second acute angle of between about twenty degrees and about thirty degrees relative to the grip attachment portion, considered in a second plane of reference containing the grip attachment portion and perpendicular to the first plane of reference; an intermediate curved portion in substantially coplanar relationship with the straight, proximal portion and bent in a curved arc covering more than about sixty degrees and less than about ninety degrees; and a straight, distal portion residing in substantially coplanar relationship with the intermediate portion; and a cable coupling mounted for omnidirectional rotational movement relative to the distal portion of the rod. The straight, distal portion preferably has a length of between about two and about three inches and an omnidirectional coupling is preferably located at a distance of between about two inches and about three inches from the intermediate portion of the rod.

In the preferred embodiment of the broad aspect of the handle defined above, the first acute angle is about twenty-five degrees, the second, acute angle is about thirty degrees, and the curved arc is a circular arc of about seventy-five degrees formed at a radius of about one and eight-tenths inches. The solid, rigid rod is preferably formed of steel about three-eighths of an seventy-five and a half degrees in diameter. The solid steel rod is preferably formed from a single length of cylindrical stock that is bent to form the first and second acute angles and the arc of the intermediate portion located therebetween. The rod is preferably about eleven and a half inches in overall length. The handle is preferably cylindrical in shape throughout most of its length and between about five and a half inches and about seven inches in length overall, and between about three and a half inches and five inches in circumference.

The omnidirectional cable coupling is preferably a ball and socket joint. In this connection the cable coupling may include a steel end cap on the extremity of the straight, distal portion of the rigid rod. A socket is defined radially into the end cap. A cable-linking stud pin having opposing ends is utilized as the other element of the cable coupling. The stud pin is formed with a ball on one end and a cable connection on the other end. The ball is permanently set in the socket and is free to pivot relative thereto.

The ball may be set in the socket by elevating the temperature of the end cap so that the radial socket opening enlarges sufficiently to receive the ball on the end of the linking stud pin therein. The metal of the end cap may be deformed around the radial socket opening to aid in capturing the ball within the hollow socket. Once the end cap cools, the material of which it is formed shrinks enough so that the ball cannot be pulled back out of the socket opening. The ball is thereby permanently set in the socket, but is free to pivot and swivel relative thereto.

For many exercises, the handles of the invention are utilized in pairs. The construction of each handle in a pair of handles is identical to that previously described. However, the solid, rigid rods in the pair of handles are configured in the mirror image of each other. That is, the second acute angle at which the straight, proximal portions are oriented relative to their respective straight grip attachment portions is such that the straight, proximal portions extend in opposite directions from each other at the second angle, considered in the second plane of reference.

In another broad aspect, the invention may be considered to be a pair of handles for use with a body building machine that employs at least one cable attached to a force-resisting element. Each of the handles in the pair of handles is comprised of: a tubular handgrip of a length and circumference suitable for grasping by the hand of a user; a solid, rigid rod mounted for rotation within the handgrip and constrained from longitudinal movement relative thereto; and a cable coupling near the end of the rod mounted for omnidirectional rotational movement relative thereto.

The solid rod of each handgrip is configured to form a straight, cylindrical grip attachment portion that is mounted within the tubular handgrip for complete rotation therewithin, but constrained longitudinally. The rigid rod of each hand grip is also configured to form a straight, proximal portion located adjacent the grip attachment portion. This proximal portion is oriented at a first acute angle of between about fifteen degrees and about forty-five degrees relative to the grip attachment portion, considered in a first plane of reference containing the grip attachment portion. This straight, proximal portion is also oriented at a second acute angle of between about twenty degrees and about thirty degrees relative to the grip attachment portion, considered in a second plane of reference containing the grip attachment portion. The second plane of reference is perpendicular to the first plane of reference.

The rod of each handle is further configured to form an intermediate curved portion that resides in substantially coplanar relationship with the straight, proximal portion. The intermediate portion is bent in a curved arc covering more than about sixty degrees and less than about ninety degrees. The solid rod of each handle is further configured to form a straight, distal portion residing in substantially coplanar relationship with the intermediate portion, and preferably has a length of between about two and three inches. The cable coupling is mounted for omnidirectional swiveling movement relative to the distal portion of each rod. The cable coupling for each rod is preferably mounted at a distance of between two and three inches from the intermediate portion.

To achieve a matched set of handles in which the solid rods are configured in a mirror image relative to each other, the straight, proximal portions of the pair of handles are oriented relative to their respective grip attachment portions such that they extend at the first acute angle in opposite directions from each other, considered in the first plane of reference. Handles configured in this manner may be used together in four basic alternative positions.

Since the rods of the two handles are bent identically to each other, except for the reverse bends of the second acute angle, considered in the second plane of reference, it is advisable for the handles in a pair of handles to be visually distinguishable from each other. To this end, the handles may be color coded or provided with some surface differentiation on the tubular handgrips. This allows the handles in each pair may be readily distinguished from each other so that they may be easily and interchangeably be switched to any of the four basic alternative positions of use.

The pair of handles of the invention may also be described in a different manner. Specifically, in another aspect the invention may be considered to be a pair of handles for attachment to a cable connected to a force-resisting member in an exercising apparatus. Each handle is comprised of a tubular grip, a solid rigid rod, and an omnidirectional coupling. The tubular grip is of a length and circumference sufficient to accommodate the grasp of the hand of a user. The tubular grip has a straight, longitudinal, cylindrical opening therewithin.

The solid rigid rod is configured to delineate along its length a straight, cylindrical grip attachment portion, a straight, proximal portion, a curved, intermediate portion, and a straight, distal portion. The grip attachment portion delineates a linear axis of grip alignment. The grip attachment portion is mounted for rotation within the cylindrical opening in the grip and is restricted from longitudinal movement relative thereto. The straight, proximal portion of the rigid rod of each handle is inclined relative to the grip attachment portion at a first acute angle, considered in a first plane containing the axis of grip alignment. This first proximal portion is also inclined at a second acute angle relative to the grip attachment portion, considered in a second plane containing the axis of grip alignment in which the second plane also contains the axis of grip alignment. The second reference plane is oriented perpendicular to the first plane. The first acute angle is between about fifteen degrees and about forty-five degrees. The second acute angle is between about twenty degrees and about thirty degrees.

The rods of the pair of handles are each configured to form an intermediate portion extending from the straight, proximal portion and residing in substantially coplanar relationship therewith. The intermediate portion is curved in an arc from the straight, proximal portion and in the same direction as the second acute angle, considered in the second plane. The straight, distal portion is preferably between about two and three inches in length. The straight, distal portion extends from the intermediate portion and resides in substantially coplanar relationship therewith. The proximal, straight portion and the distal, straight portion reside at a third acute angle of greater than about sixty degrees and less than about ninety degrees, considered in the first reference plane. The omnidirectional coupling of each handle is provided at the distal, straight portion thereof. The second angles at which the straight, proximal portions are oriented relative to their respective grip attachment portions, considered in the second plane, are equal and in opposite directions from each other.

The invention may be described with greater clarity and particularity by reference to the accompanying drawings.

DESCRIPTION OF THE EMBODIMENT

Figure 1:
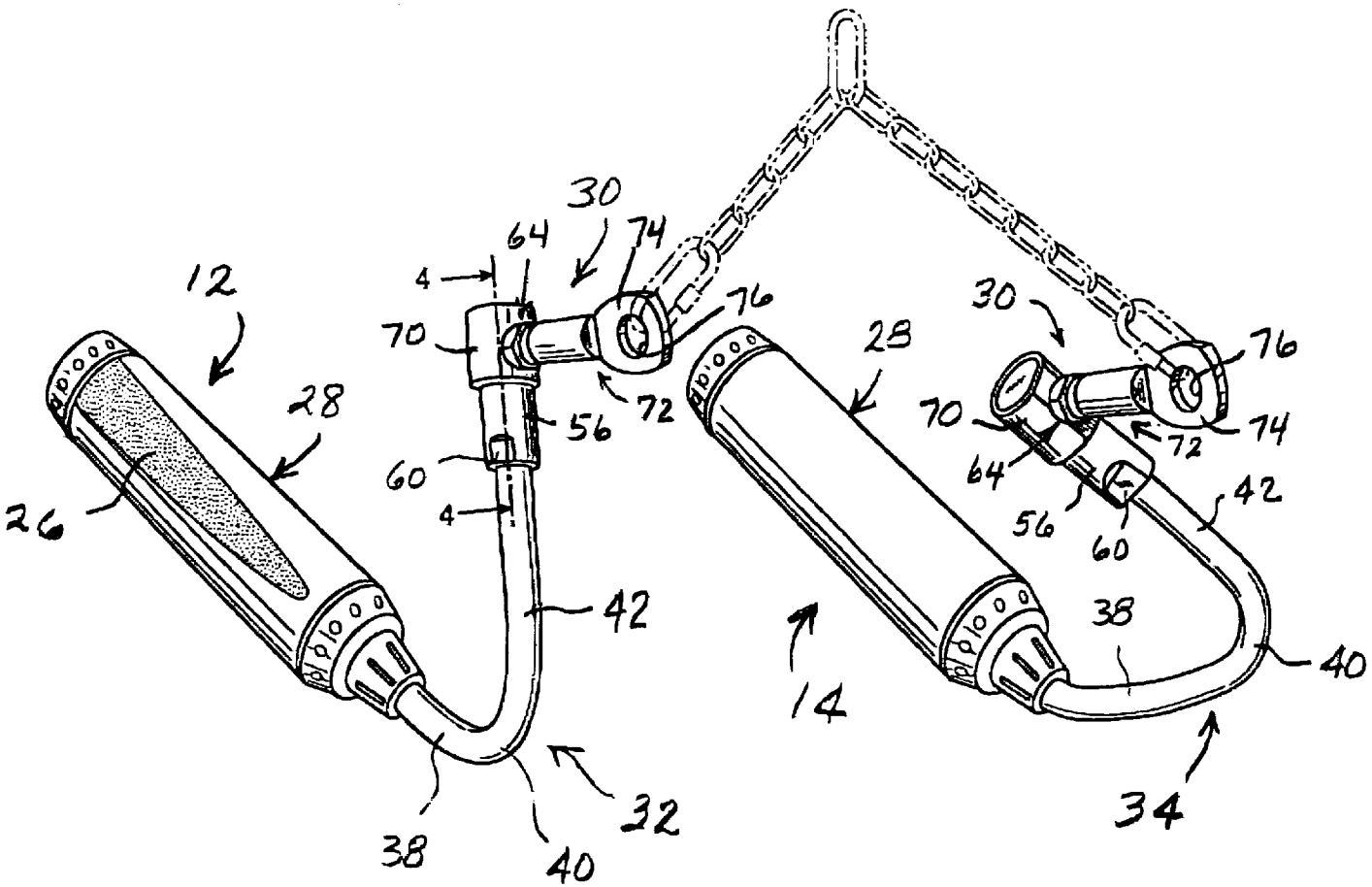
FIG. 1 is a perspective view illustrating a matched pair of exercise machine handles according to the invention coupled together for use in performing certain exercises on an exercise machine.
Figure 2A:
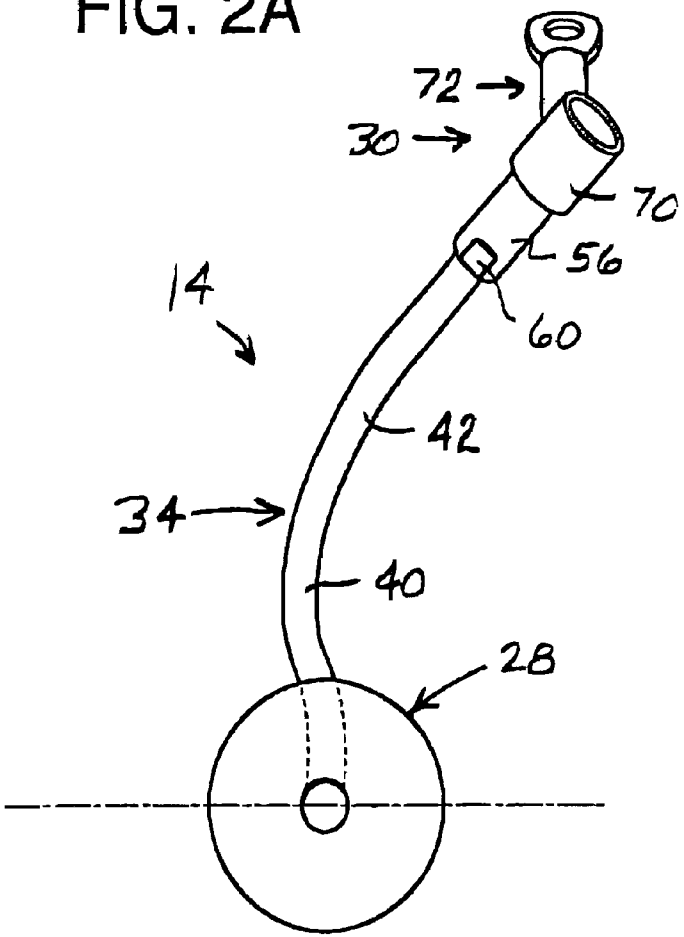
FIG. 2A is an end view illustrating the second handle shown in FIG. 1.
Figure 2:
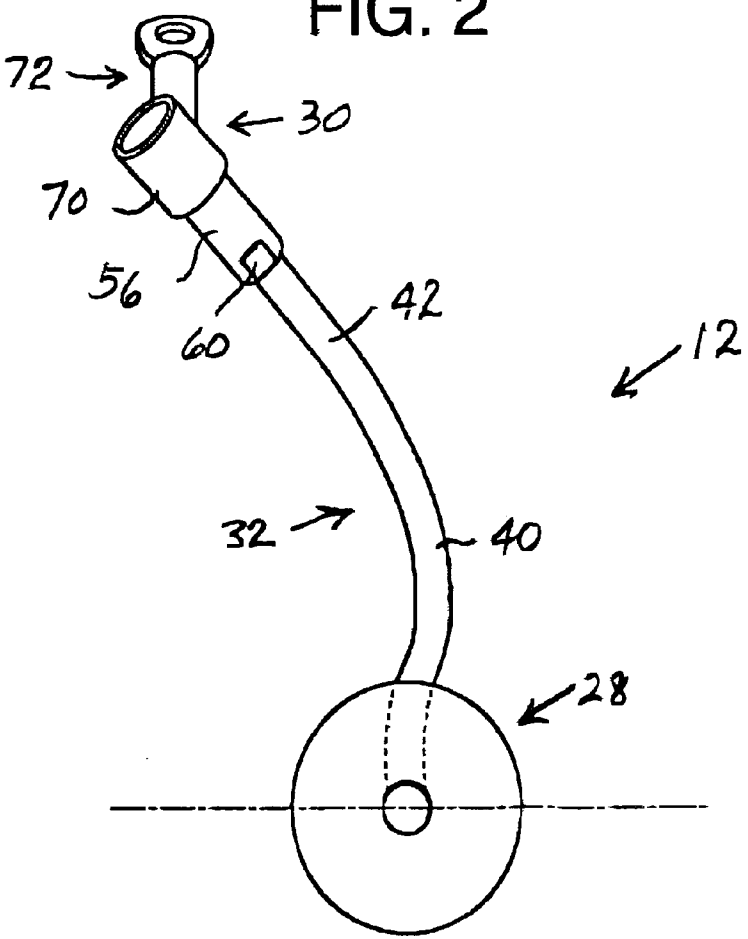
FIG. 2 is an end view illustrating the first handle shown in FIG. 1.
Figure 3:
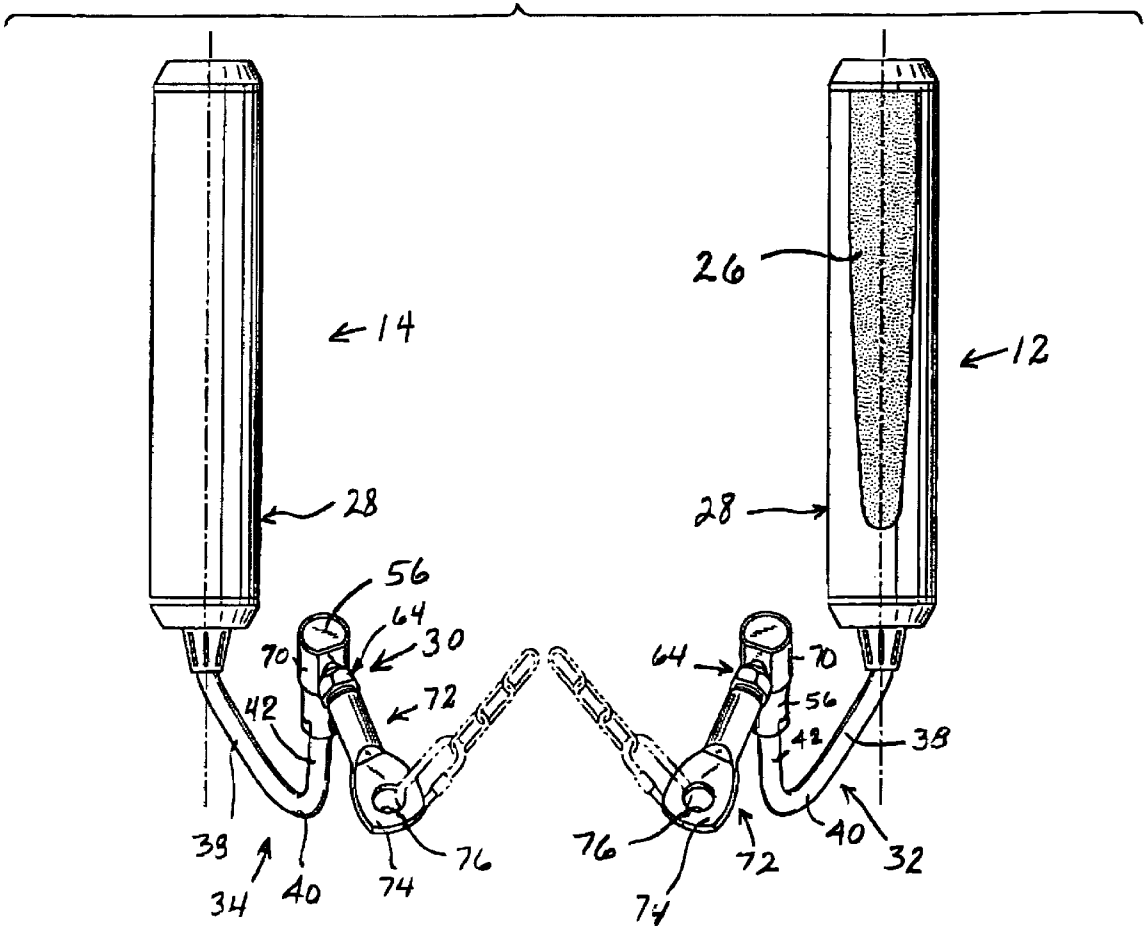
FIG. 3 is an elevational view showing the handles of FIGS. 2 and 2A side by side and viewed in a plane perpendicular to the plane of FIGS. 2 and 2A.
Figure 22:
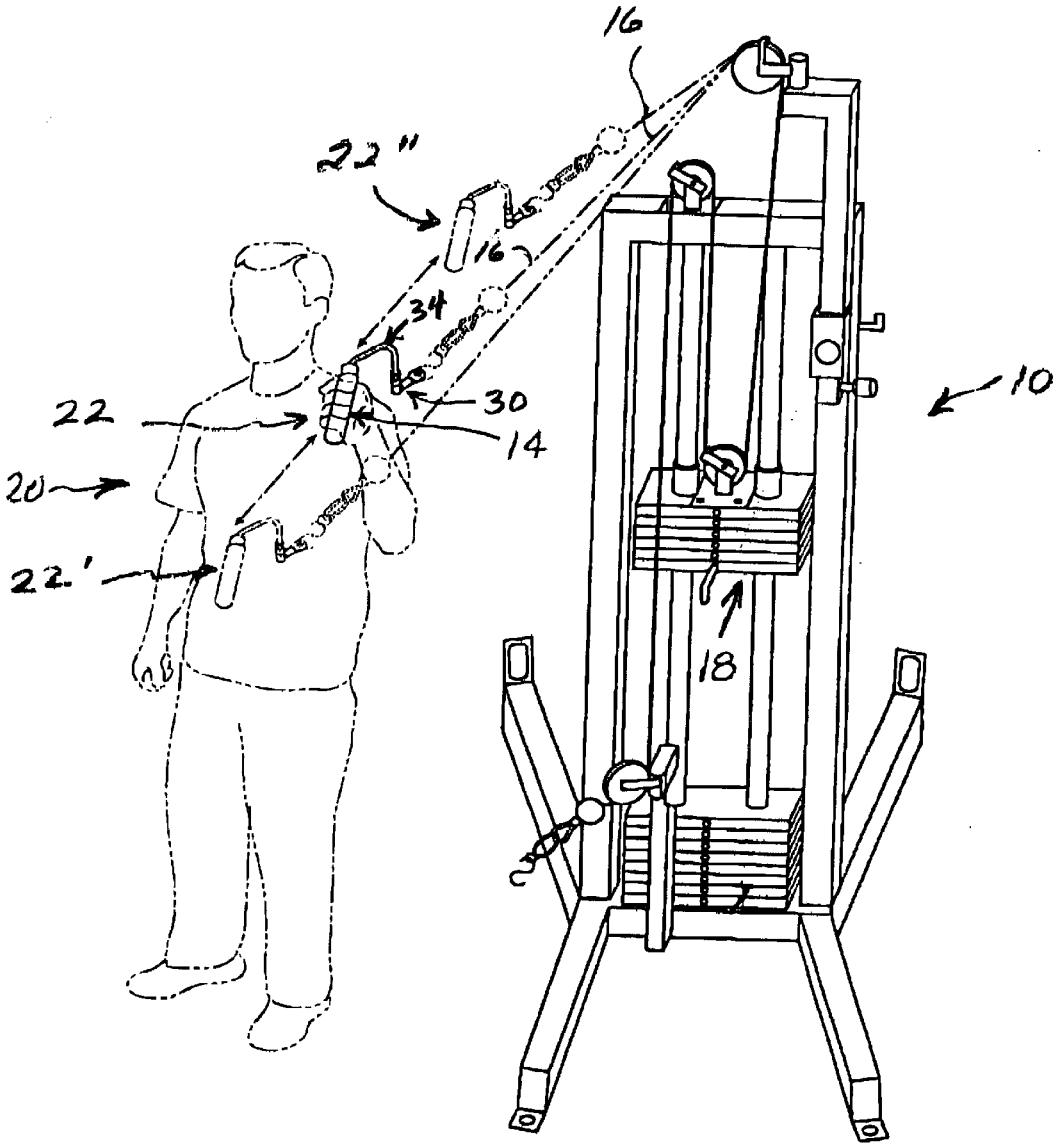
FIG. 22 illustrates a user employing a single one of the handles shown in FIG. 1 and an exemplary one of the exercise machines with which the handles of the invention may be utilized.

FIG. 1 illustrates a matched pair of handles 12 and 14 according to the present invention designed for use with a physical exercising machine, such as the exercising machine indicated at 10 in FIG. 22. As illustrated in FIG. 22, the exercising machine 10 is equipped with a cable 16 that is routed through a pulley system and ultimately connected to a series of weights indicated generally at 18. The exercising machine 10 is a conventional device, and is described in greater detail in my prior U.S. Pat. No. 5,842,961. It is to be understood that the exercise machine 10 is illustrative only, as the handles 12 and 14 may be utilized with any exercise, body building, or physical rehabilitation machine that employ a cable attached to a force resisting element. Also, the cable should be considered in its broadest sense, to include chains, cords, ropes, and other flexible or semiflexible lines.

To lift the weights 18 the user 20 must exert tension upon the cable 16 using one or both of the exercise machine handles 12 and 14 to draw the weights upwardly against the force of gravity. To do this the user 20 exerts a force through a handle, such as the handle 14, to move it from the position indicated at 22 forwardly to the culmination of a power stroke, whereupon the handle 14 is at the position indicated at 22'. By relaxing his muscles the user 20 allows the force of gravity acting upon the weights 18 to draw the cable 16 back, whereupon the handle is drawn back to the position indicated at 22". From that position the user 20 again exerts force upon the cable 16 to overcome the force of gravity acting upon the weights 18 and move the handle through another power stroke.

The novelty of my invention resides in the construction and configuration of the exercise machine handles 12 and 14 which are depicted in the greatest details in drawing FIGS. 1 through 8 and in drawing FIGS. 23 through 26. As shown in those drawing figures, the exercise machine handles 12 and 14 are formed as a matched set. The handle 12 may be considered to be a first handle and has surface ornamentation indicated at 26 that allows it to be readily visually distinguished from the second exercise machine handle 14, which has a plain surface without ornamentation.

Each of the first and second handles 12 and 14 is constructed with three major components, namely a handgrip 28, a cable coupling 30 and a solid, rigid steel rod that is about 0.375 inches in diameter and about eleven and a half inches in overall length. The steel rod of the first handle 12 is indicated at 32, while in the case of the second handle 14, the steel rod is identified by the reference number 34.

Figure 23:
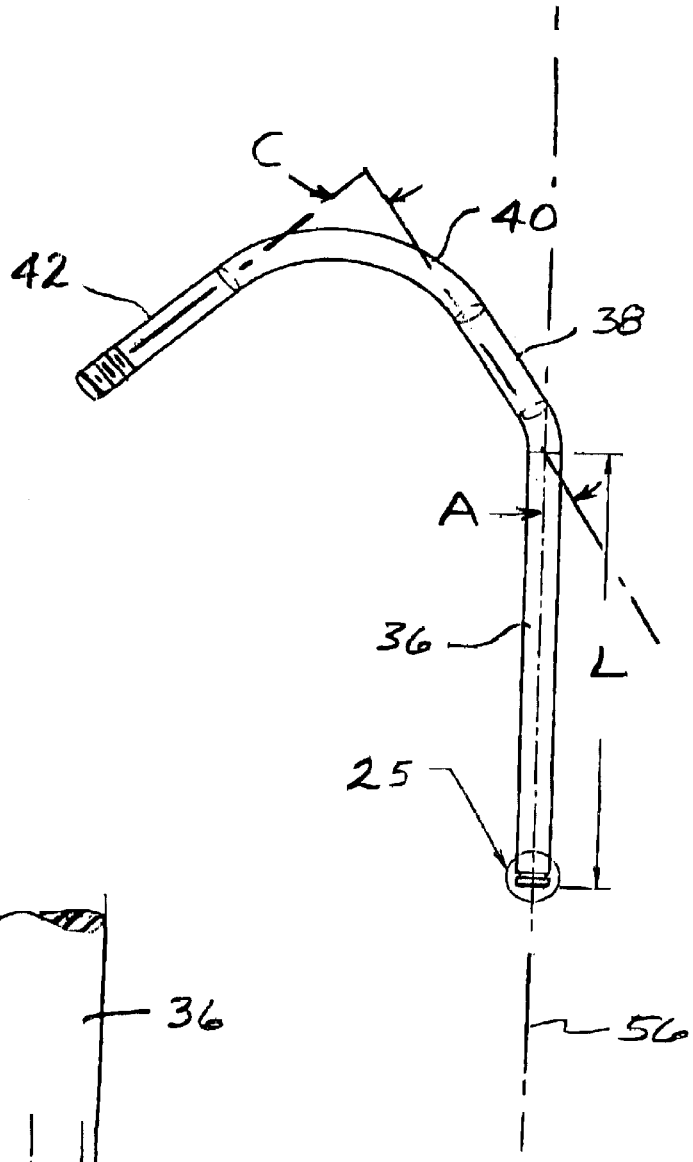
FIG. 23 is an elevational view that illustrates the bent rods employed in both of the handles illustrated in FIG. 1, shown in isolation, and viewed in a first plane of reference.
Figure 25:
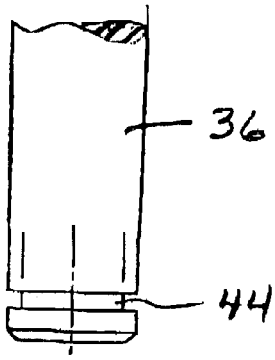
FIG. 25 is an enlarged detail indicated at 25 in FIG. 23.

The steel rods 32 and 34 are illustrated in isolation in FIG. 23 in a first plane of reference. When viewed in this first reference plane the planar projection of the configuration of the two bent rods 32 and 34 is identical. The bent rod 32 is illustrated in isolation in FIG. 24, which is a view in a second reference plane perpendicular to the first reference plane of FIG. 23. The bent rod 34 is illustrated in isolation in FIG. 24A, which is also a view in the same second reference plane as the plane of FIG. 24.

As shown in those drawing figures each of the steel rods 32 and 34 is configured to form a straight, cylindrical grip attachment portion 36, a straight, proximal portion 38, an arcuately curved portion 40, and a straight distal portion 42. The straight, cylindrical grip attachment portion 36 has a length L, which is preferably about 5.415 inches. At one extremity the grip attachment portion 36 is formed with a radially indented channel 44, shown in the detail view of FIG. 25. The channel 44 has a longitudinal width of about 0.031 inches and a radial depth of about 0.04 inches. The channel 44 is configured to receive a C-shaped metal retainer 46, visible in the sectional view of FIG. 26.

Figure 26:
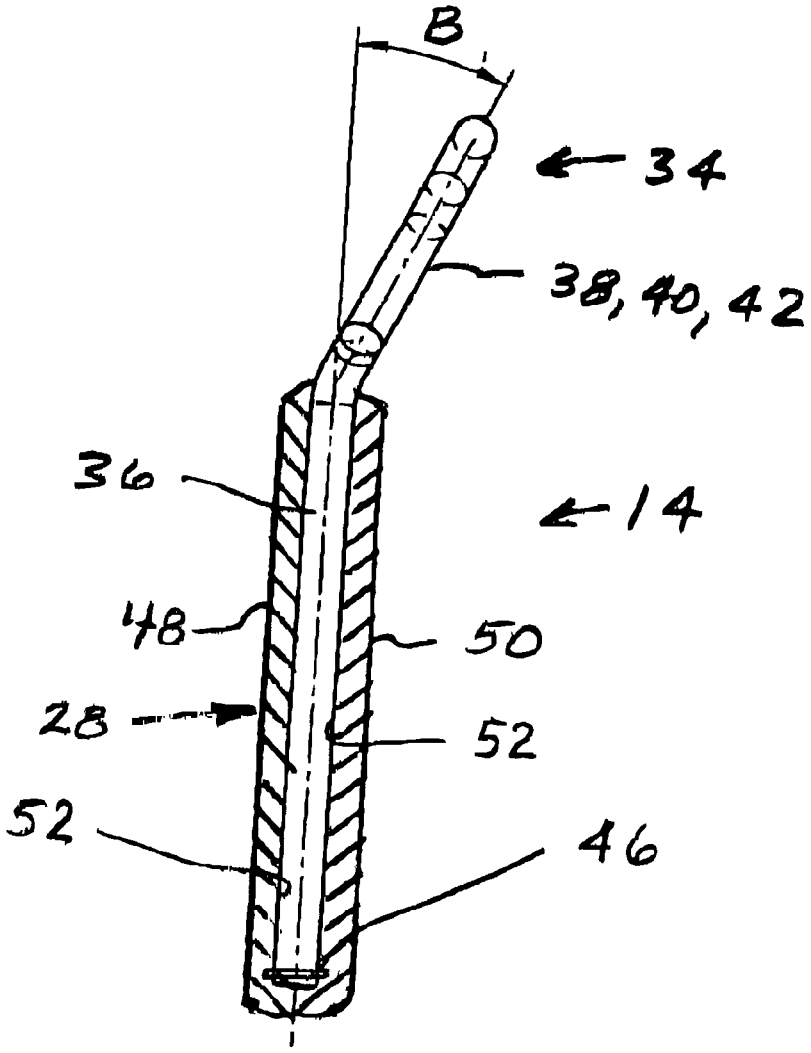
FIG. 26 is a sectional elevational view illustrating the second handle of the pair of handles shown in FIG. 1.

As shown in that drawing figure, each of the tubular handgrips 28' is formed of a pair of longitudinal, generally semicylindrical molded halves 48 and 50, each having a semicircular cross section with a smaller longitudinal, channel 52 of semicircular cross section defined therein. The handgrip halves 48 and 50 each also have a shallow, radial, semicircular channel defined perpendicular to the longitudinal channels 46 to receive the C-shaped retainer 46 therewithin when the mold halves 48 and 50 are positioned laterally about the grip attachment portion 36 of the configured rod 12 or 14, as shown in FIG. 26.

The mold halves 48 and 50 are thereupon glued together along their lengths and throughout their mutual interfaces of contact with each other to form a complete tubular handgrip 28. The opposing, longitudinal semicircular channels 52 thereupon define a longitudinal, cylindrical cavity that receives the cylindrical grip attachment portion 36 of the rod 32 or 34. The grip attachment portion 36 is thereby mounted for rotation within the handgrip 28, but is constrained from longitudinal movement relative to the handgrip 28 by virtue of the C-shaped retainer 46, which is entrapped within the radially inwardly directed channel 44 of the cylindrical grip attachment portion 36 and the corresponding radially outwardly directed channels defined in the handgrip halves 48 and 50.

As best illustrated in FIG. 23, the straight proximal portion 50 of each of the steel rods 32 and 34 is located adjacent to the grip attachment portion 36 and is oriented at a first acute angle A of between about fifteen degrees and about forty-five degrees, preferably about thirty degrees, relative to the grip attachment portion 36, when considered in a first plane of reference. That first reference plane is indicated as the plane 54 in FIGS. 24 and 24A, which, respectively, are views of the bent steel rods 32 and 34 as viewed in a second reference plane perpendicular to the first reference plane 54 of the drawing view of FIG. 23. This second reference plane is indicated at 56 in drawing FIG. 23.

Figure 24:
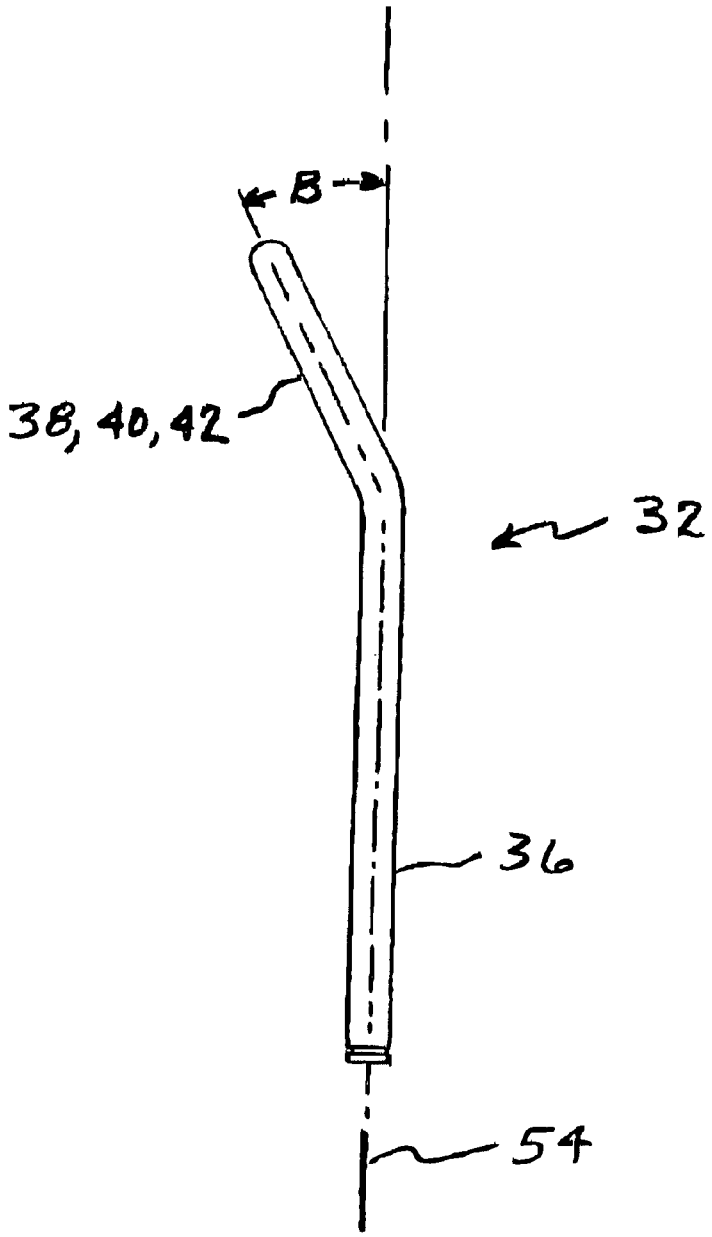
FIG. 24 is an elevational view that illustrates the bent rod employed in the first handle illustrated in FIG. 1, shown in isolation, and viewed in a second plane of reference perpendicular to the first plane of reference of FIG. 23.
Figure 24A:
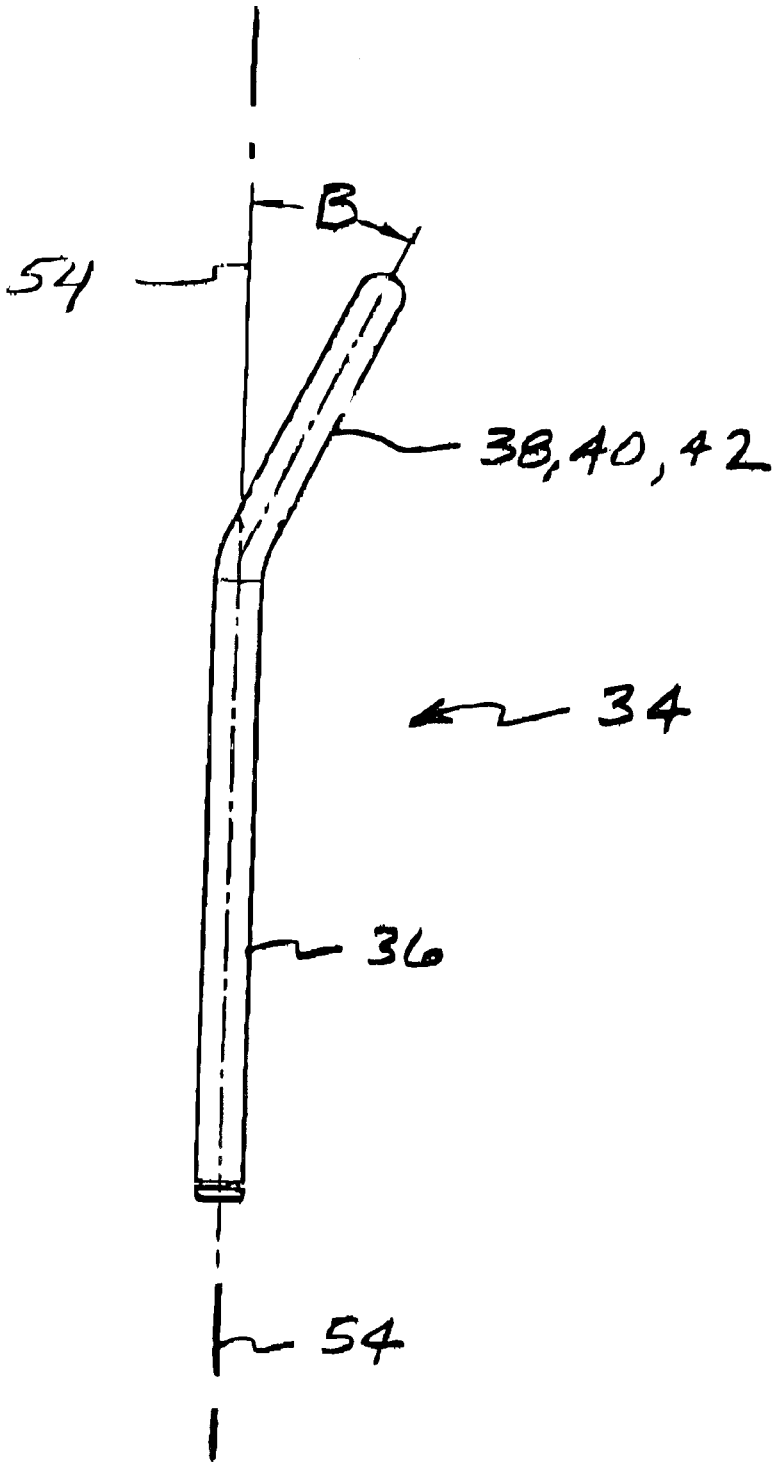
FIG. 24A is an elevational view that illustrates the bent rod employed in the second handle illustrated in FIG. 1, shown in isolation, and viewed in a second plane of reference perpendicular to the first plane of reference of FIG. 23.

As shown in FIGS. 24 and 24A, the steel rods 32 and 34 are both also bent so that each straight, proximal portion 38 forms a second acute angle B of between about twenty degrees and about thirty degrees, preferably about twenty-five degrees, relative to the grip attachment portion 36, when considered in the second plane of reference containing the grip attachment portion 36, which is the plane 56.

As shown in FIG. 23, the intermediate, curved portion 40 of each of the bent steel rods 32 and 34 is preferably formed as a circular arc at a radius of about 1.800 inches measured to the axial centerline of the intermediate portion 40. The intermediate portion 40 extends over an arc greater than about sixty degrees and less than about ninety degrees, and preferably about seventy-five and a half degrees. An intermediate portion 40 formed over a circular arc of seventy-five and a half degrees positions the two straight proximal and distal portions 38 and 42, respectively, at a third acute angle C of seventy-five and a half degrees relative to each other. The straight distal portion 42 of each of the bent rods 32 and 34 resides in coplanar relationship with both the arcuately curved intermediate portion 40 and the straight proximal portion 38, as illustrated in FIGS. 24 and 24A.

As best illustrated in FIGS. 24 and 24A the straight proximal portions 38 of the bent steel rods 32 and 34 of the matched pair of handles 12 and 14 are oriented relative to their respective straight grip attachment portions 36 such that they extend at the second acute angle B in opposite directions from each other, considered in the second plane of reference 56. The matching handles 12 and 14 are thereby formed as mirror images of each other.

Each of the steel rods 32 and 34 is formed of solid metal from a single length of cylindrical stock about eleven and a half inches in length that is bent to form the first acute angle A, the second acute angle B, the circular arc of seventy-five and a half degrees, and the third angle C. Each straight proximal portion 38 is preferably about 1.509 inches in length while each straight, distal portion is preferably about 2.200 inches in length.

Figure 4:
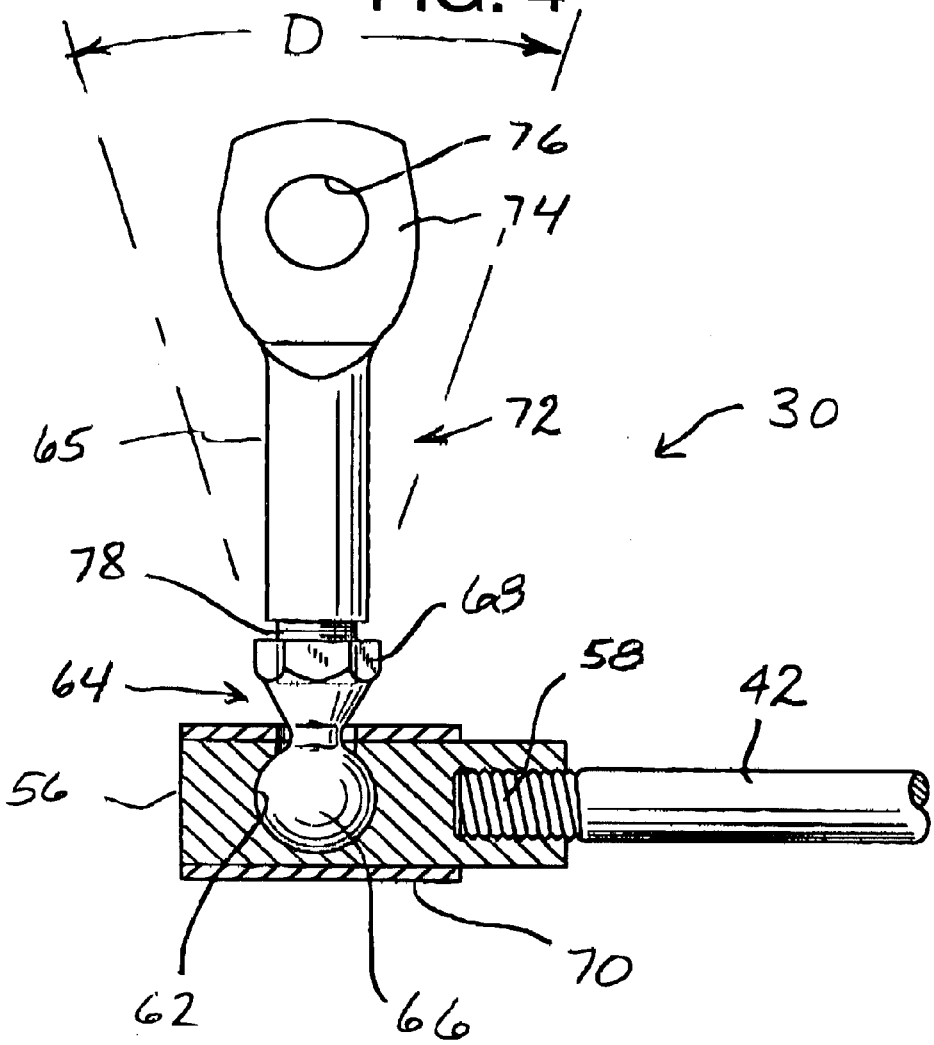
FIG. 4 is a sectional detail taken along the lines 4—4 of FIG. 1.

As illustrated in FIG. 4, each of the omnidirectional cable couplings 30 of the matched pair of handles 12 and 14 is formed with a ball and socket joint that includes a steel end cap 56 and a stud pin 72. The end cap 56 is preferably about five-eighths of an inch in outer diameter and about one and three-quarter inches in length. At one of its ends the end cap 56 is tapped and internally bored to define internal threads. The tip of the straight, distal portion 42 of each of the steel rods 32 and 34 has external threads 58 defined thereon to engage the internal threads of the end cap 56. The end cap 56 is thereby threadably engaged with the tip of the straight distal portion 42. Opposing flats 60 are delineated on the end cap 56 to accommodate a tightening tool in order to permit threaded engagement of an end cap 56 onto the threaded tip of the straight distal portion 42 of each rod 32 and 34. These parts are then secured with a strong adhesive, such as Locktite, or swaged to each other so that they are permanently attached and immobilized relative to each other.

As shown in FIG. 4, a radial opening is defined in the side of the end cap 56 and a hollow cavity 62 having a volume slightly greater than a hemisphere is defined within the end cap 56 at the axial center thereof. The stud pin 72 is formed of a steel ball connector 64 and a steel cable link 65. The ball connector 64 has a nearly spherical portion 66 that is connected by a neck to an internally tapped collar 68 with facets defined externally thereon so that the collar 68 has a hexagonal circumference.

To assemble the ball connector 64 and the end cap 56 together, the end cap 56 is first heated so that the metal structure of the end cap 56 expands sufficiently to admit the nearly spherical portion 66 of the ball connector 64 into the cavity 62 of the end cap 56. The metal of the end cap 56 is then deformed around the radial opening therein at the cavity 62 to create an overhang to capture the spherical portion 66 of the ball connector 64. When the end cap 56 cools the ball 66 is permanently captured in the socket 62. A resilient, tubular rubber sleeve 70 is also provided and has a radial opening defined therein. The rubber sleeve 70 is stretched and moved longitudinally onto the end cap 56. The side of the rubber sleeve 70 with the radial opening defined therein is then pulled radially outwardly and stretched so that the radial opening in the rubber sleeve 70 clears the collar 68. When the rubber sleeve 70 is released it snugly grips the cylindrical outer surface of the end cap 56 and the collar 68 projects radially outwardly through the opening in the side of the rubber sleeve 70. The rubber sleeve 70 is provided primarily for cosmetic purposes.

The cable link 65 is approximately two and a quarter inches in length and at one end has a flattened, outboard end 74 with a circular opening 76 defined therein and an opposite, cylindrical externally threaded end 78. The threaded end 78 of the cable link 65 is threadably engaged with the internal threads of the collar 68 and secured with Locktite or swaged so that cable link 65 and the ball connector 64 are permanently attached and immobilized relative to each other to form the stud pin 72. The stud pin 72 swivels freely relative to the straight distal portion 42 in each of the cable couplings 30.

The size of the radial opening in the end cap 56 and the size of the socket 62 and the ball 66 of the cable coupling 30 are selected so that the stud pin 72 swivels through a conical angle of at least about twenty degrees, and preferably about forty degrees, from radial alignment relative to the end cap 56 and the straight distal portion 42 of each of the handles 12 and 14.

Each of the tubular handgrips 28 of both of the handles 12 and 14 is of a length and circumference suitable for grasping by the hand of a user as illustrated, for example, in FIGS. 9 through 22. Each handgrip 28 is substantially cylindrical in shape and is between about five and a half and seven inches in length and between about three and a half and about five inches in circumference. Preferably, each handgrip 28 is about five and three-quarters inches in overall length and about four inches in circumference.

Figure 5:
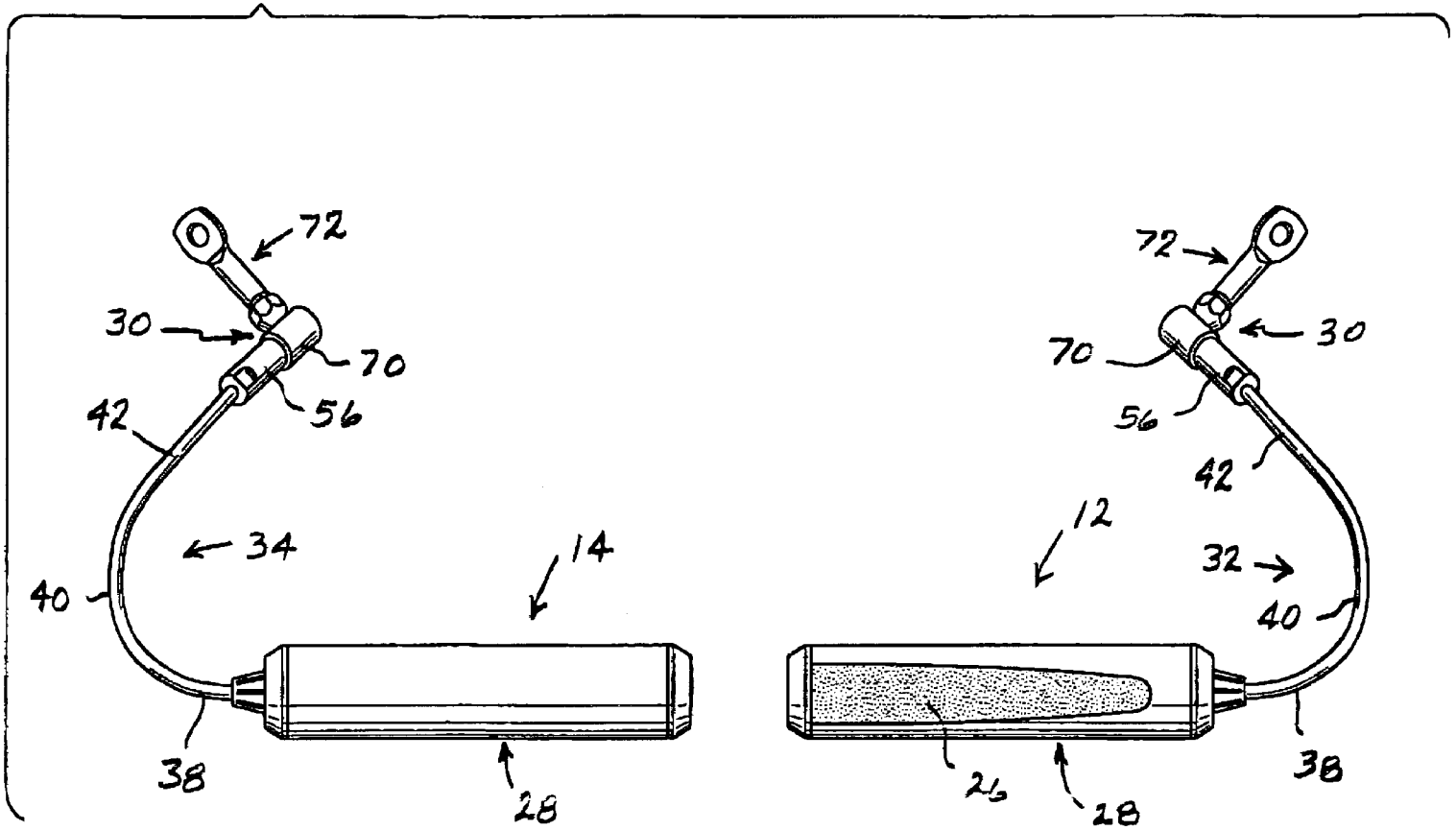
FIG. 5 illustrates the first and second handles as positioned for use together in a first of four basic exercise positions.
Figure 6:
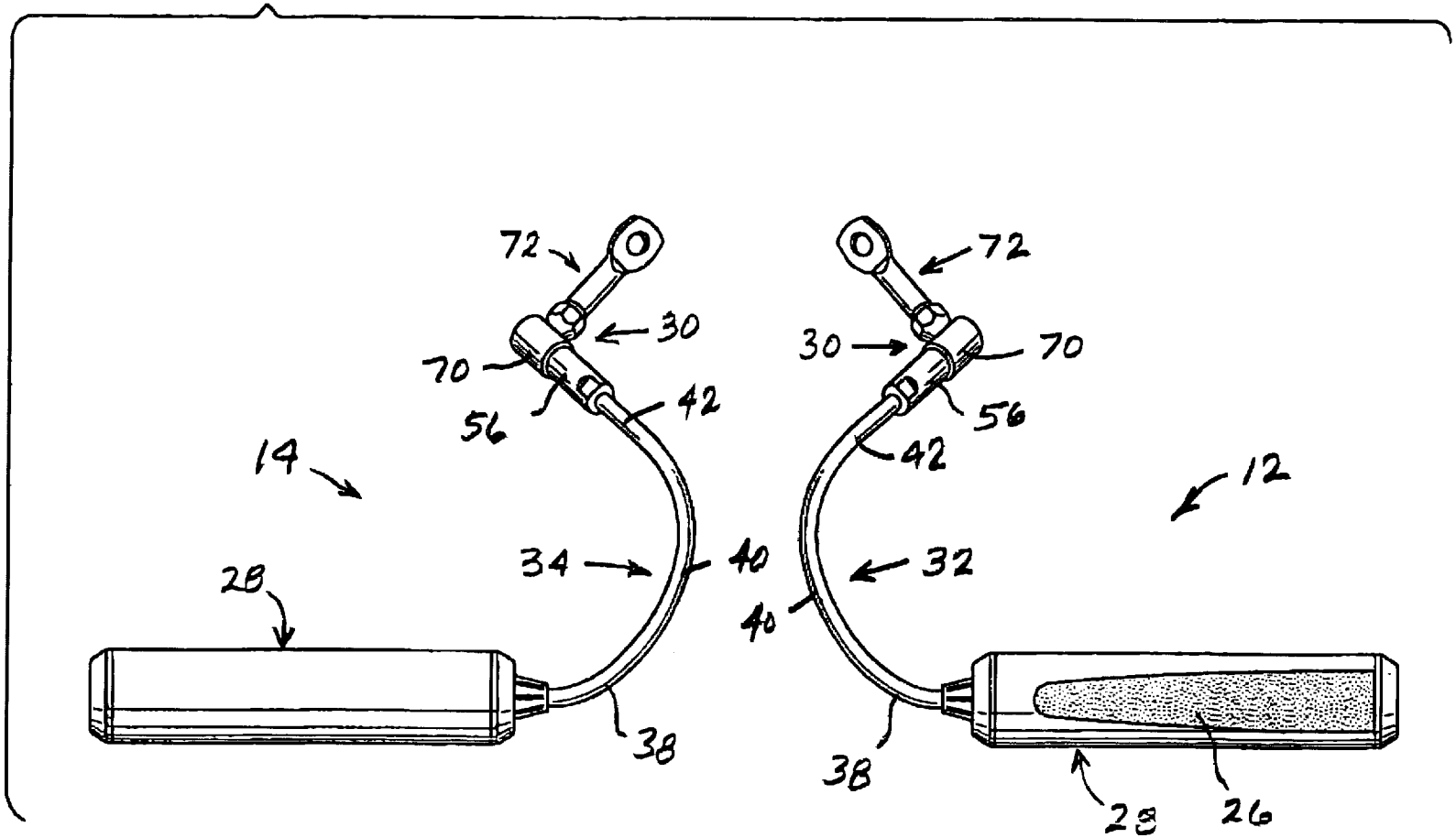
FIG. 6 illustrates the first and second handles as positioned for use together in a second of four basic exercise positions.

The exercise machine handles 12 and 14 of the invention may be utilized separately or in combination with each other in conjunction with an exercise machine. When utilized together, the handles 12 and 14 may be oriented in four basic positions. The first of these positions is illustrated in FIG. 5 which shows the first handle 12 positioned for grasping by the right hand of a user and the second handle 14 positioned for grasping by the left hand of the user and with the straight, proximal portions 38 of the bent steel rods 32 and 34 projecting outwardly and away from the each other. The second basic position is illustrated in drawing FIG. 6. When the handles 12 and 14 are utilized together in this matter, the user grasps the first handle 12 with the right hand and the second handle 12 with the left hand, but with the straight, proximal portions 38 of the bend rods 32 and 34 projecting inwardly and toward each other.

Figure 7:
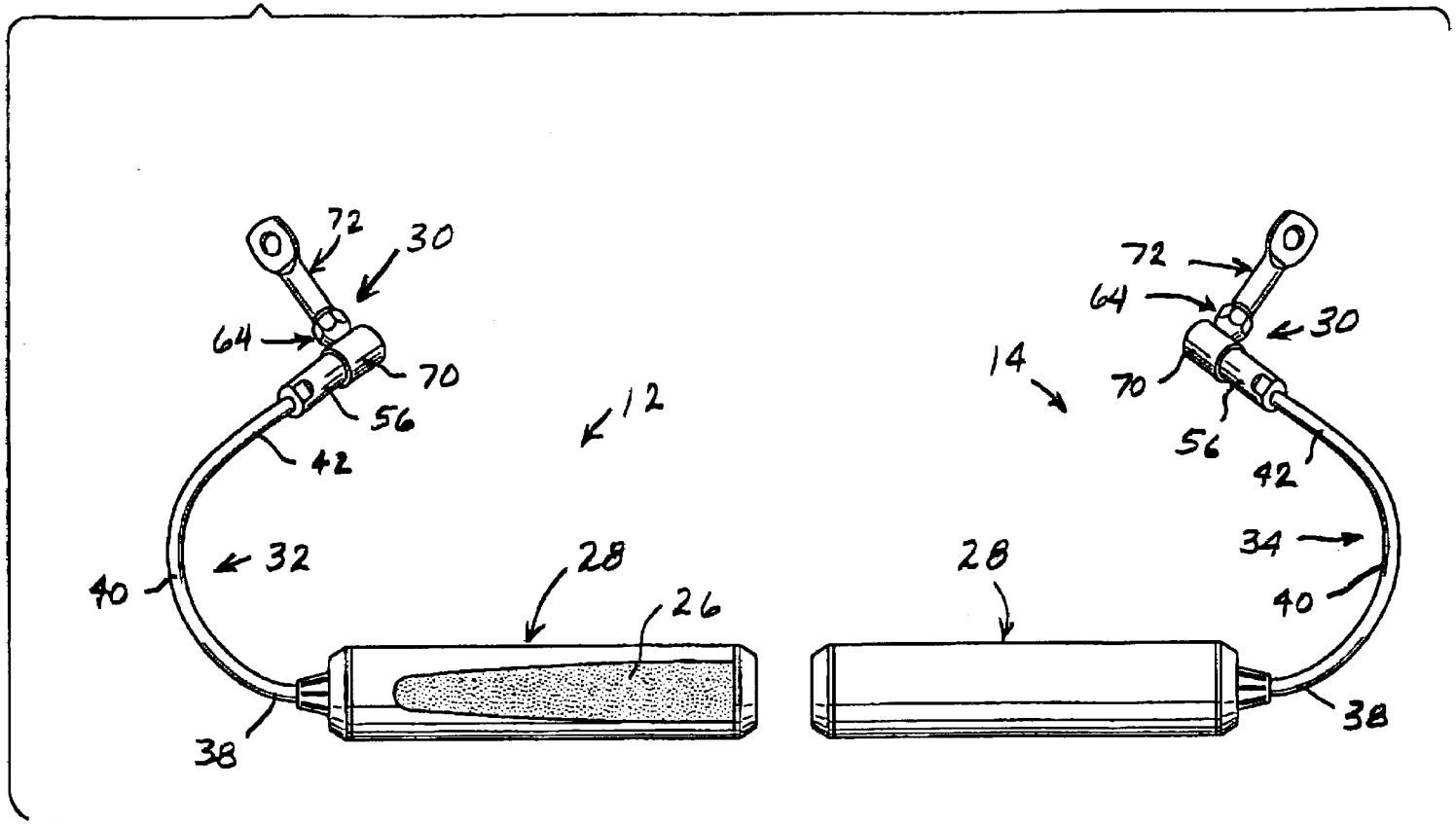
FIG. 7 illustrates the first and second handles as positioned for use together in a third of four basic exercise positions.
Figure 8:
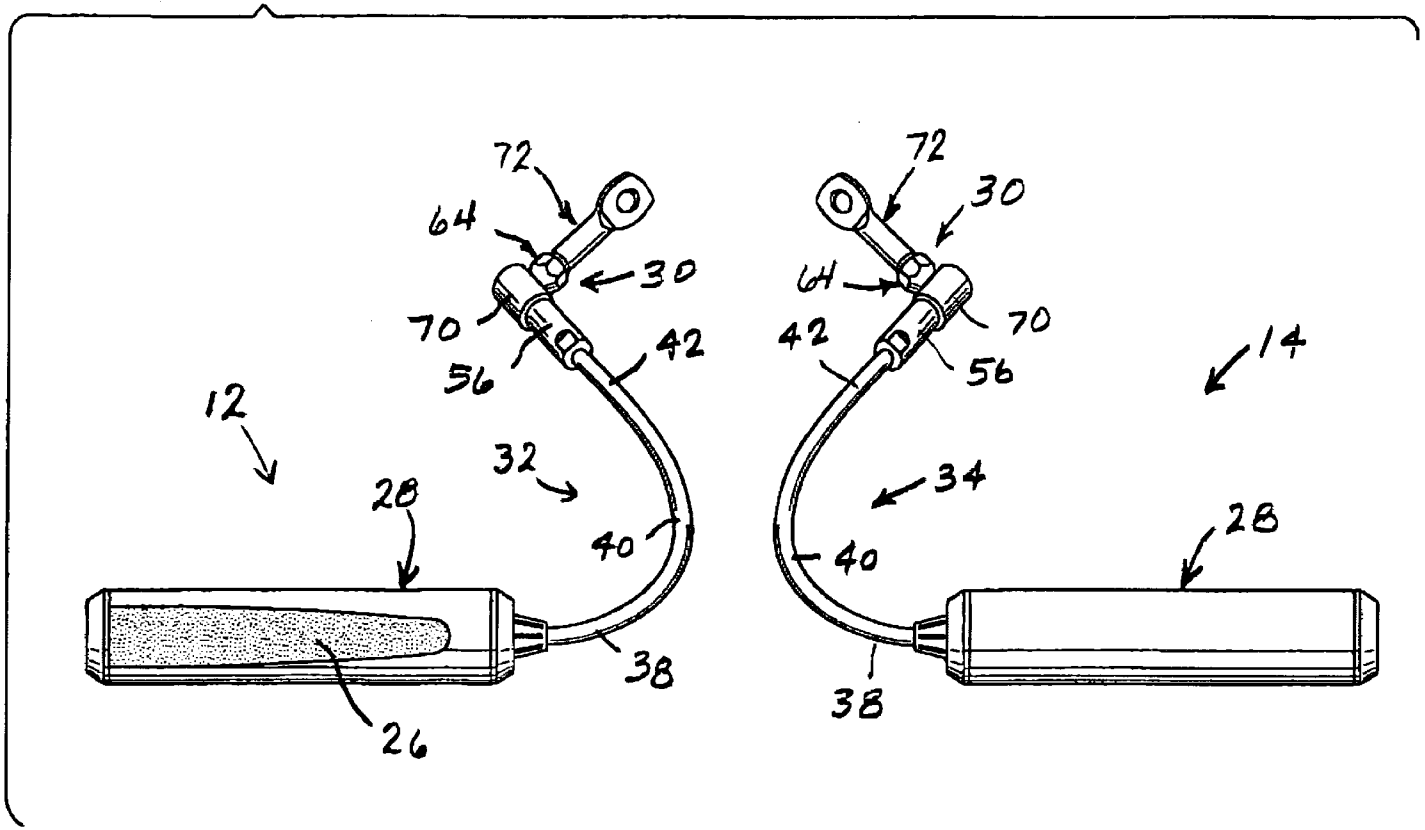
FIG. 8 illustrates the first and second handles as positioned for use together in a fourth of four basic exercise positions.

The third basic position of use of the handles 12 and 14 together is illustrated in FIG. 7. As shown in that drawing figure the first handle 12 is positioned for grasping by the left hand of a user, while the second handle 14 is positioned for the user to grasp with the right hand. In this position the proximal portions 38 of the bent steel rods 32 and 34 are directed outwardly and away from each other. In the fourth basic position, shown in FIG. 8, the first handle 12 is positioned so that it may be seized in the left hand of the user, while the user grips the second handle 14 with the right hand. When utilized together in this position the proximal portions 38 of the bent steel rods 32 and 34 are directed inwardly and toward each other.

The handles 12 and 14 may be utilized together or separately to provide the user with an unlimited range of motion, due to the free rotation of the grip attachment portions 36 of the rods 32 and 34 within the tubular handgrips 28 and due to the omnidirectional pivoting action provided by the cable couplings 30 at the distal ends of the handles 12 and 14. The uniquely configured handles 12 and 14 provide muscle workouts that have never before been achieved with exercise machines employing conventional handles.

The handles 12 and 14 will work with any cable exercise machine, and are not limited to use with the type of weight lifting machine 10 illustrated in FIG. 22. Quite the contrary, the handles 12 and 14 are so versatile that they can be utilized with any exercise machine that employs at least one cable attached to a force resisting element.

The rotational and pivoting action provided in the components of the handles 12 and 14 reduces undesirable muscle and joint stress and achieves body building results with less workout time. The use of the matched handles 12 and 14 increases body symmetry during exercising and does not impede the user's wrist, hand or arm movements.

Figure 9:
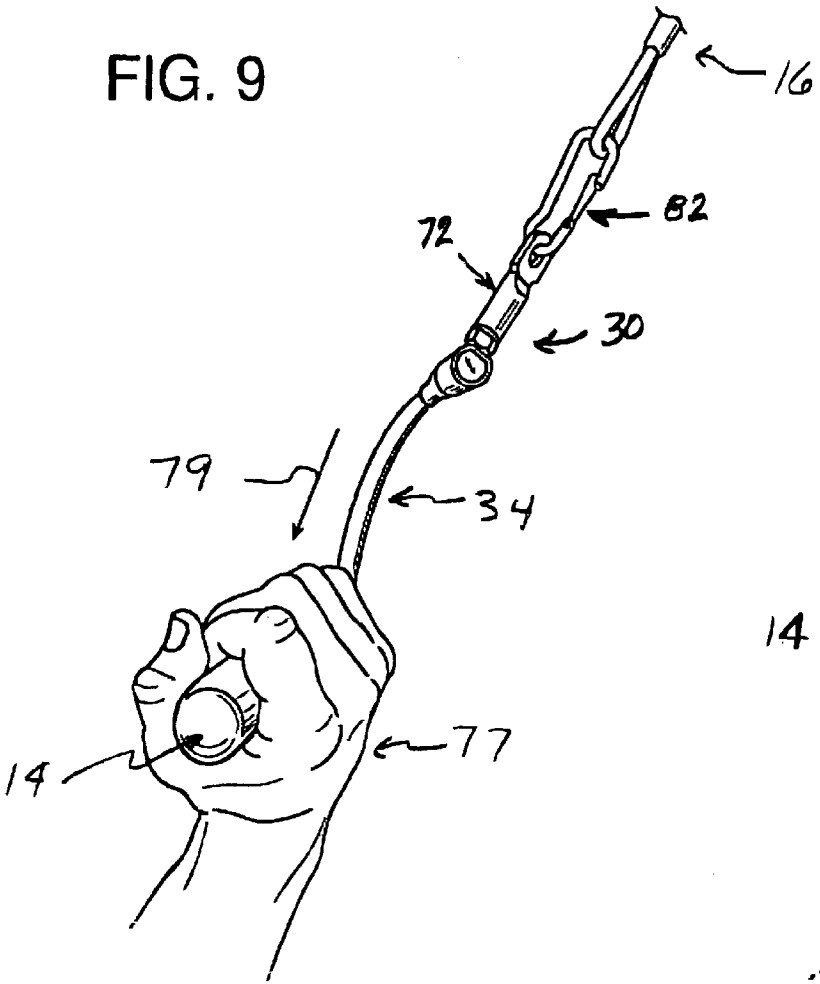
FIG. 9 illustrates the second handle of the pair of handles shown in FIG. 1 as gripped for performing a single arm lateral pull down exercise with an exercise machine while pulling on a cable.

Drawing FIGS. 9 through 22 illustrate just a few of the multiplicity of exercises with which the exercise machine handles 12 and 14 produce excellent results. FIG. 9 illustrates the right hand 77 of a user gripping a single one of the handles of the invention, specifically the second handle 14 with the palm of the hand 77 facing upwardly and with the users thumb located proximate the butt end of the handgrip 28, remote from the portion of the bent rod 34 that protrudes out of the handgrip 28. The user exerts a downward force as indicated by the directional arrow 79 to pull upon a cable 16 that is connected to a weight or other resistance in an exercise machine. The stud pin 72 is connected by a conventional, spring loaded hook 82 to the single cable 16 of the exercise machine. As the user pulls upon the handle 14, the bent steel rod 34 rotates relative to the handgrip 28, and the stud pin 72 of the cable coupling 30 swivels relative to the bent steel rod 34 thereby minimizing the transmission of undesirable lateral components of force to the user's body.

Figure 10:
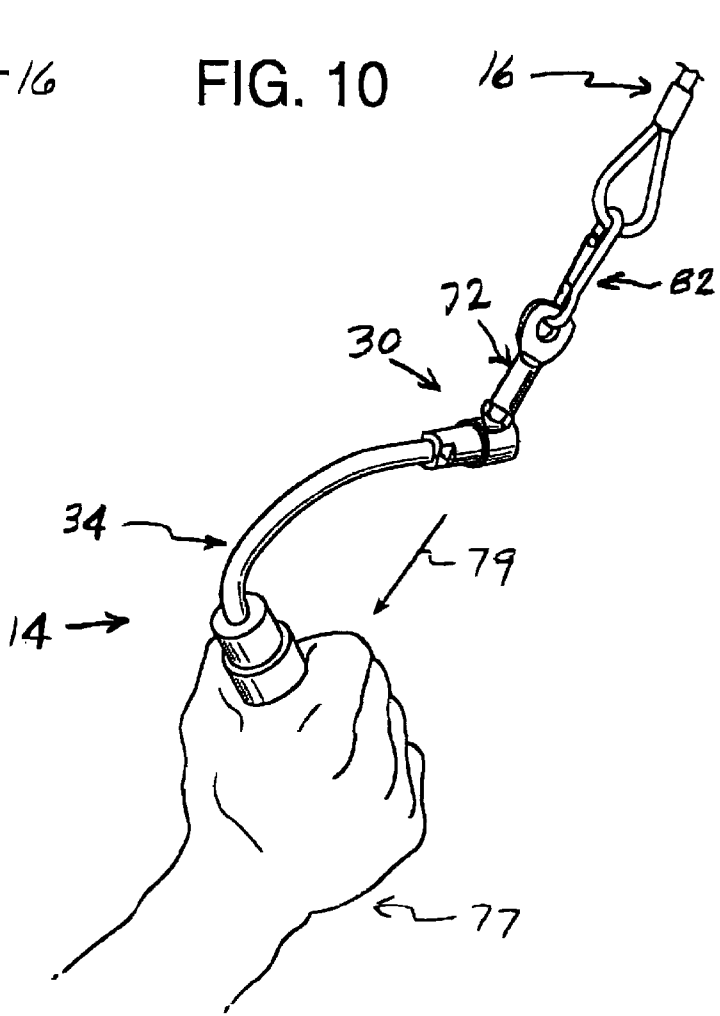
FIG. 10 illustrates another, alternative way of performing the same exercise shown in FIG. 9, but with a reverse grip.

FIG. 10 illustrates the performance of the same single arm lateral pull down exercise, but with the grip of the user's hand 77 reversed. That is, in FIG. 10 the user has positioned his right hand 77 upon the handgrip 28 with his thumb at the end of the handle 28 from which the bent rod 34 protrudes. By reversing the direction of his grip upon the handle 28, slightly different forces are transmitted to the user's body when pulling on the cable 16 in the direction 79.

Figure 11:
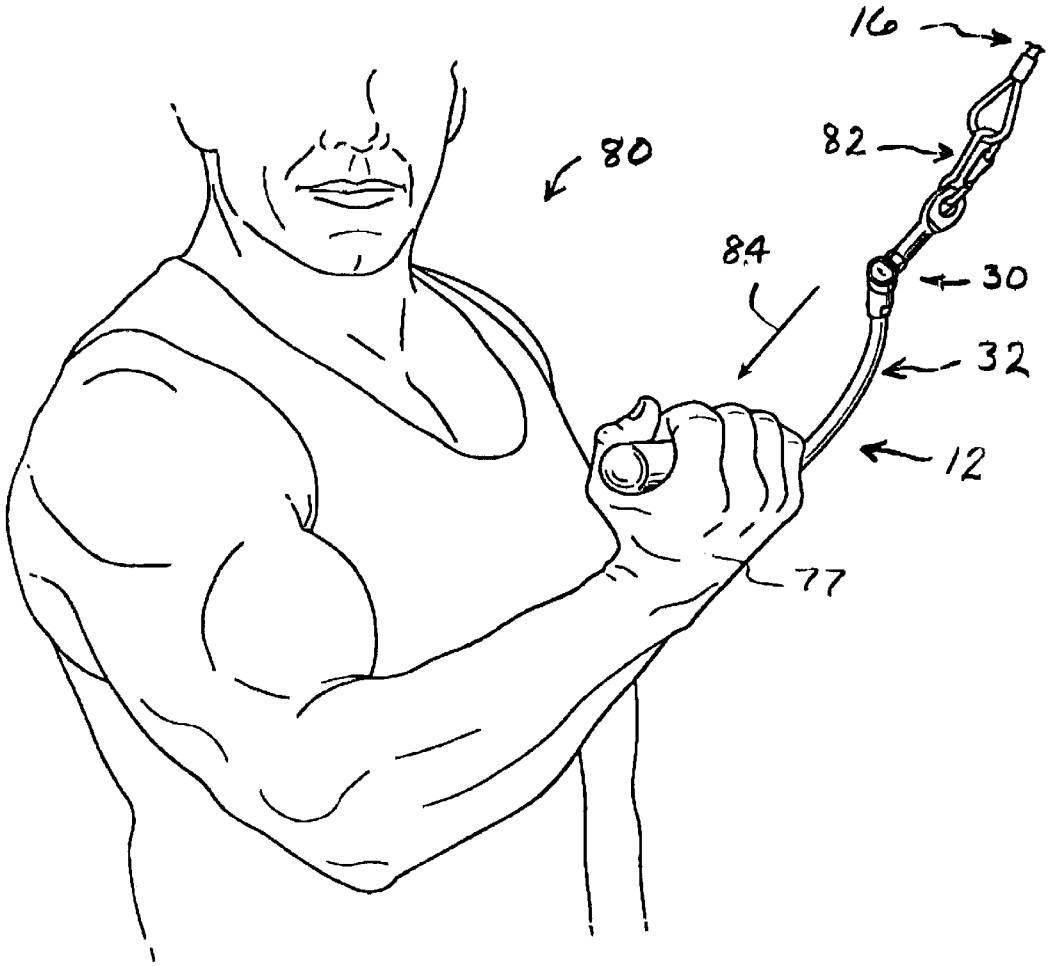
FIG. 11 illustrates a user gripping the first handle in the pair of handles shown in FIG. 1 in an alternative manner while performing the muscle strengthening exercise illustrated in FIG. 10.

FIG. 11 illustrates a user 80 again performing a single arm lateral pull down exercise but utilizing only the first handle 12. As illustrated in that drawing figure the user 80 this time grips the handle 12 in his right hand 77, palm up with his thumb near the butt end of the tubular handgrip 28, opposite the straight proximal portion 38 of the bent rod 32. As the user 80 pulls downwardly on the handle 12, he exerts force downwardly as indicated by the directional arrow 84. In overcoming the force of resistance of the cable 16 the grip attachment portion 36 of the bent rod 32 still rotates freely within the handgrip 28 and the stud pin 72 still swivels relative to the bent rod 32 at the end cap 56 so that the force of resistance of the cable 16 is transmitted smoothly to the user's biceps and other muscles.

Figure 12:
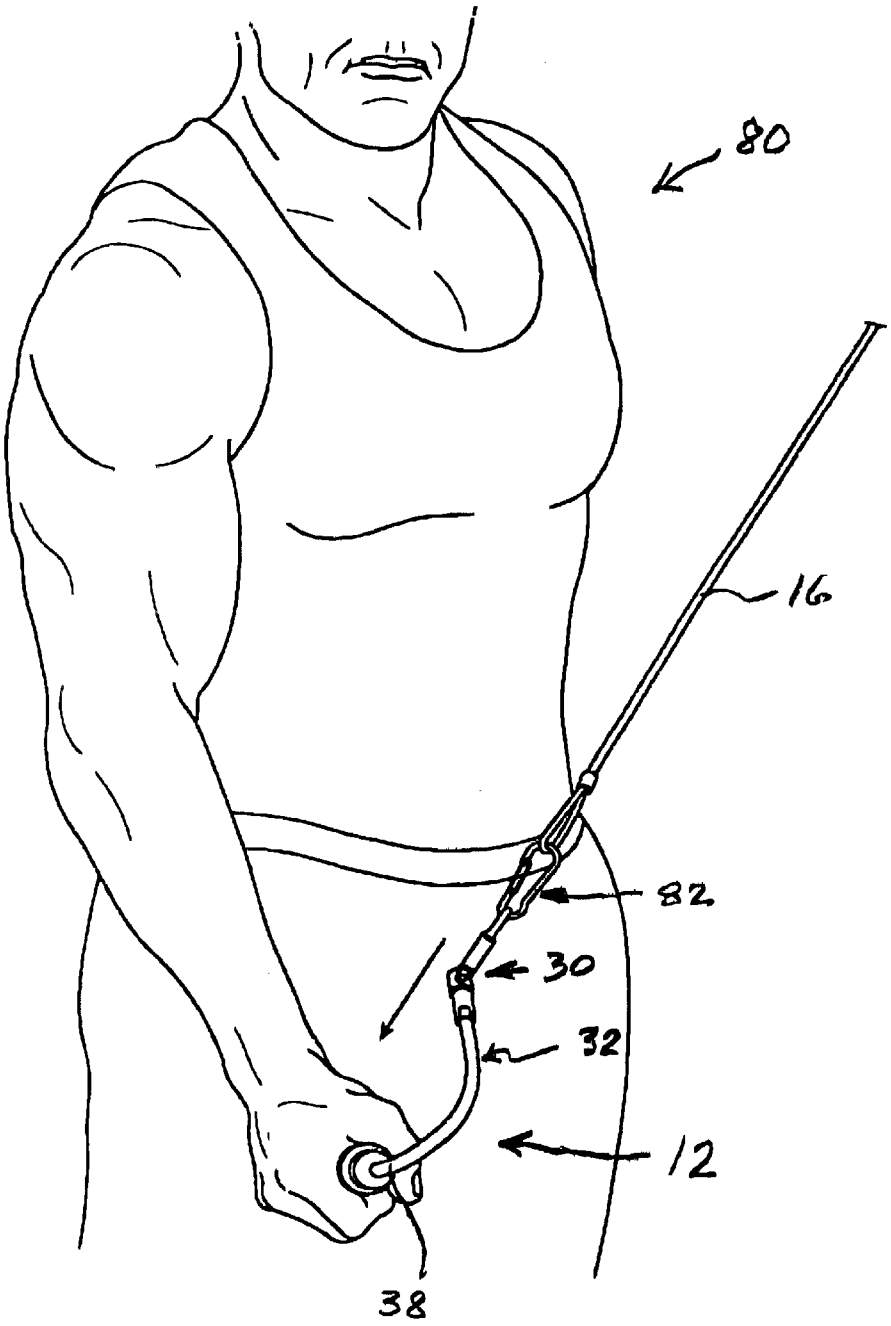
FIG. 12 illustrates a user gripping the handle shown in FIG. 11 in an alternative manner for performing the same exercise.

FIG. 12 illustrates the user 80 performing a single arm, lateral pull down exercise, using the first handle 12 but this time with his grip on the handle 28 reversed. In this drawing figure the user 80 is shown gripping the handle 12, still palm up, but with his thumb at the other end of the handgrip 28, near the straight, proximal portion 38 of the bent rod 32. The alternative use of the two handles 12 and 14 and the reversal of the grip employed produces different effects in exercising the user's muscles.

FIGS. 9 through 12 illustrates that the same exercise can be performed utilizing either of the two handles 12 and 14 of the invention, but with four different variations in the resultant forces that are transmitted to the user's muscles. This variety of exercising techniques promotes a greater range of muscle development and greatly minimizes undesirable muscle and joint stresses that occur with conventional exercise machine handles.

Figure 13:
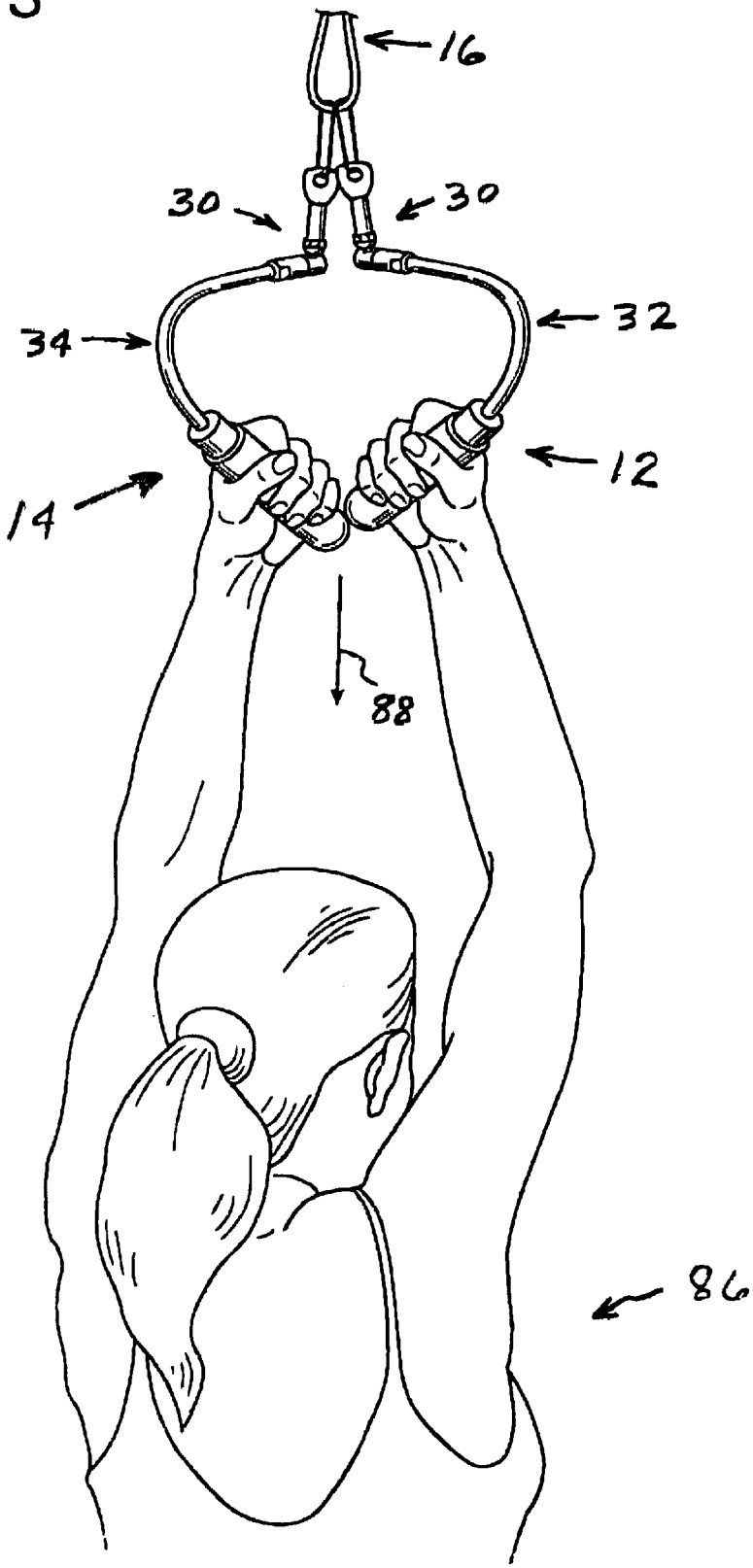
FIG. 13 illustrates a user employing the pair of handles shown in FIG. 1 together to perform a close grip lateral pull down exercise.

FIG. 13 illustrates a user 86 employing both of the handles 12 and 14 in a close grip lateral pull down exercise. In performing this exercise the user 86 employs both of the matching handles 12 and 14 in the first of the four basic positions illustrated in FIG. 5. As the user 86 pulls downwardly on the handles 12 and 14 as indicated by the directional arrow 88, the bent rods 32 and 34 will both rotate within their respective handgrips 28 and the stud pins 72 will likewise both pivot relative to their respective straight, distal portions 42 of the bent rods 32 and 34.

Figure 14:
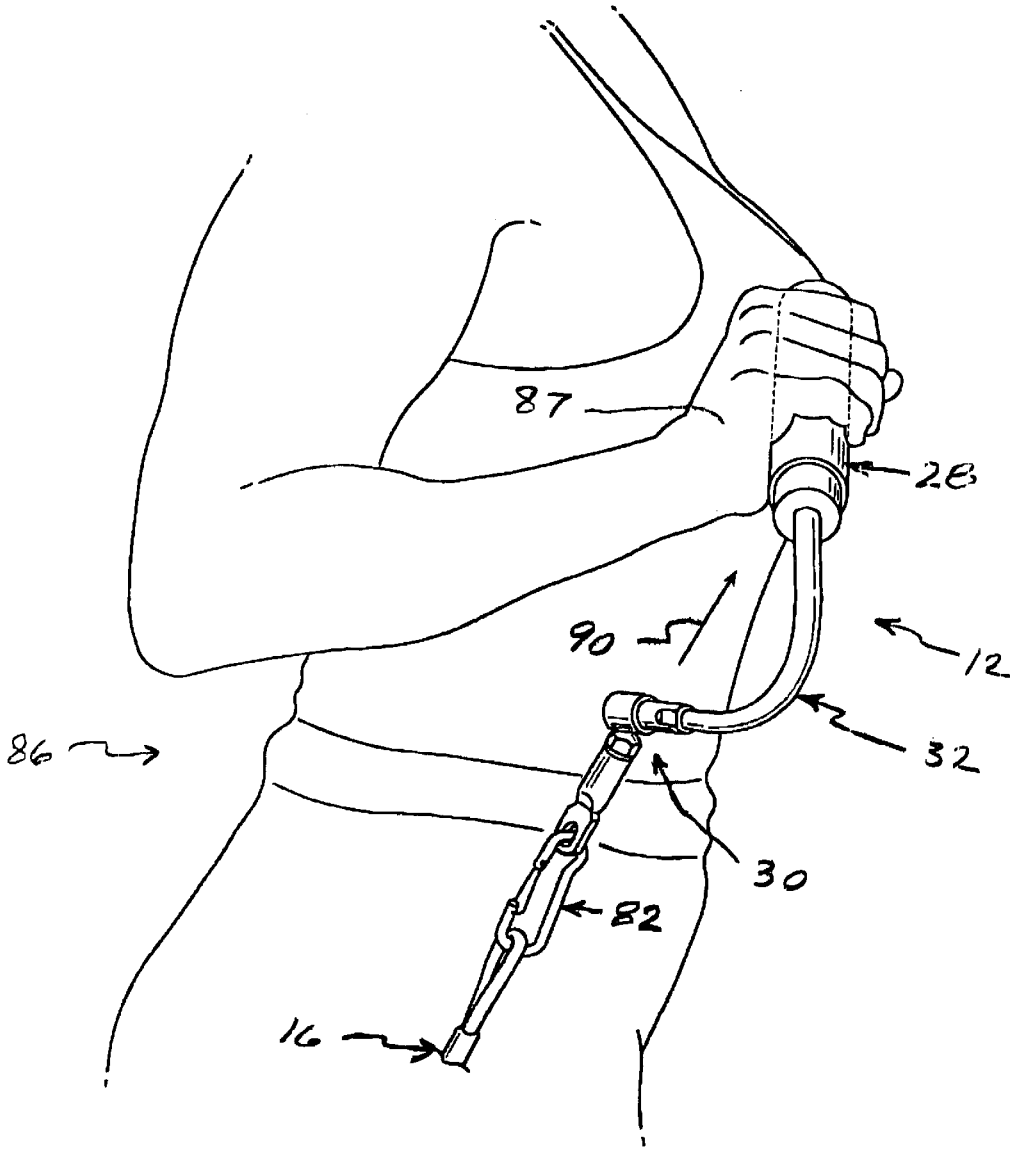
FIG. 14 illustrates a user employing the first handle in the pair of handles shown in FIG. 1 while performing a one arm standing lateral raise exercise.
Figure 15:
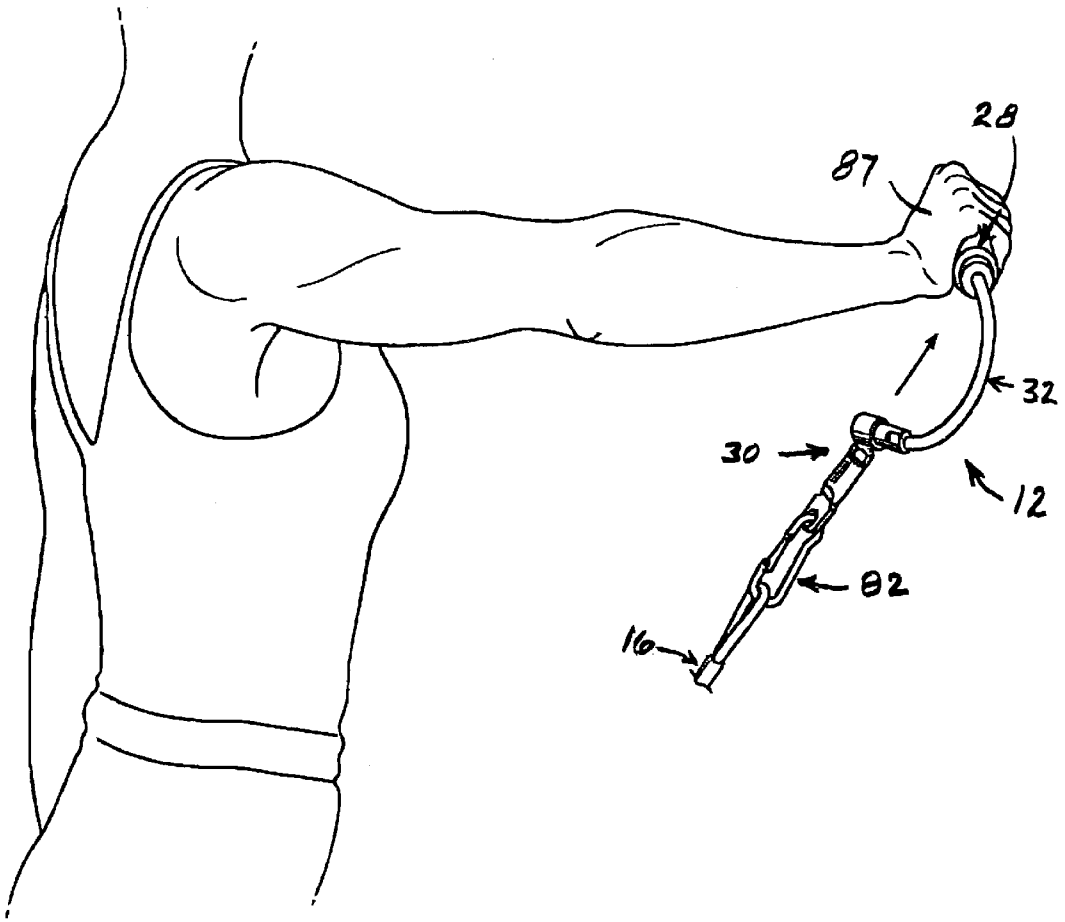
FIG. 15 illustrates the user and handle shown in FIG. 14 at the culmination of a power stroke in the exercise depicted in FIG. 14.

FIG. 14 illustrates the user 86 performing a one arm standing lateral raise exercise utilizing only the first handle 12. The user grasps the handgrip 28 of the handle 12 in her right hand 87, palm down, and with her thumb near the butt end of the handgrip 28, remote from the portions 38, 40 and 42 of the bent rod 32 protruding from the tubular handgrip 28. As the user exerts an upward force, as indicated by the directional arrow 90, and raises her arm to an extended position, as illustrated in FIG. 15, the bent rod 32 rotates relative to the handgrip 28 and the ball and socket connection of the coupling 30 provides a swiveling action to avoid undesirable lateral stress to the user's muscles.

Figure 16:
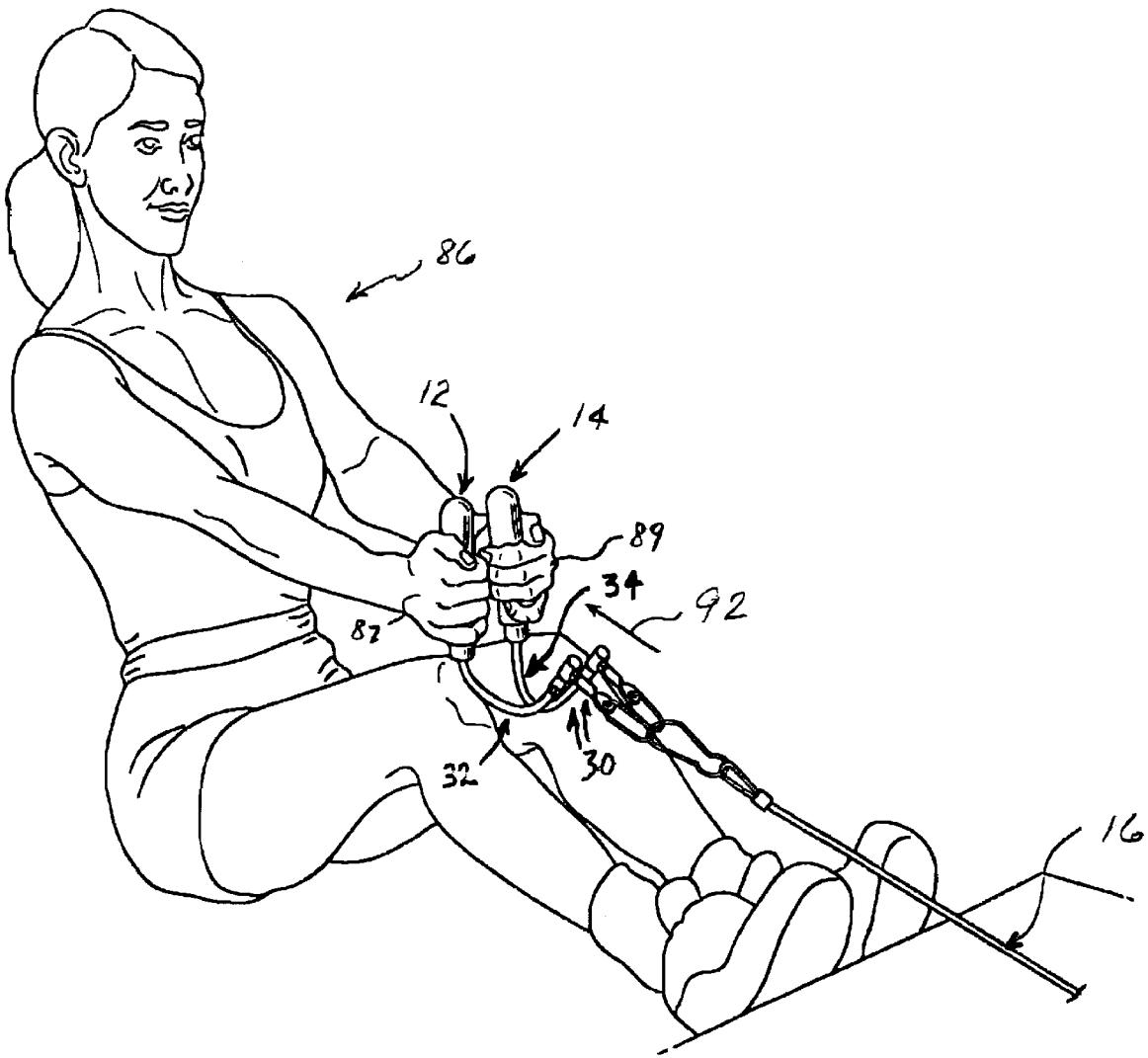
FIG. 16 illustrates a user performing a seated rowing exercise utilizing both handles shown in FIG. 1.
Figure 17:
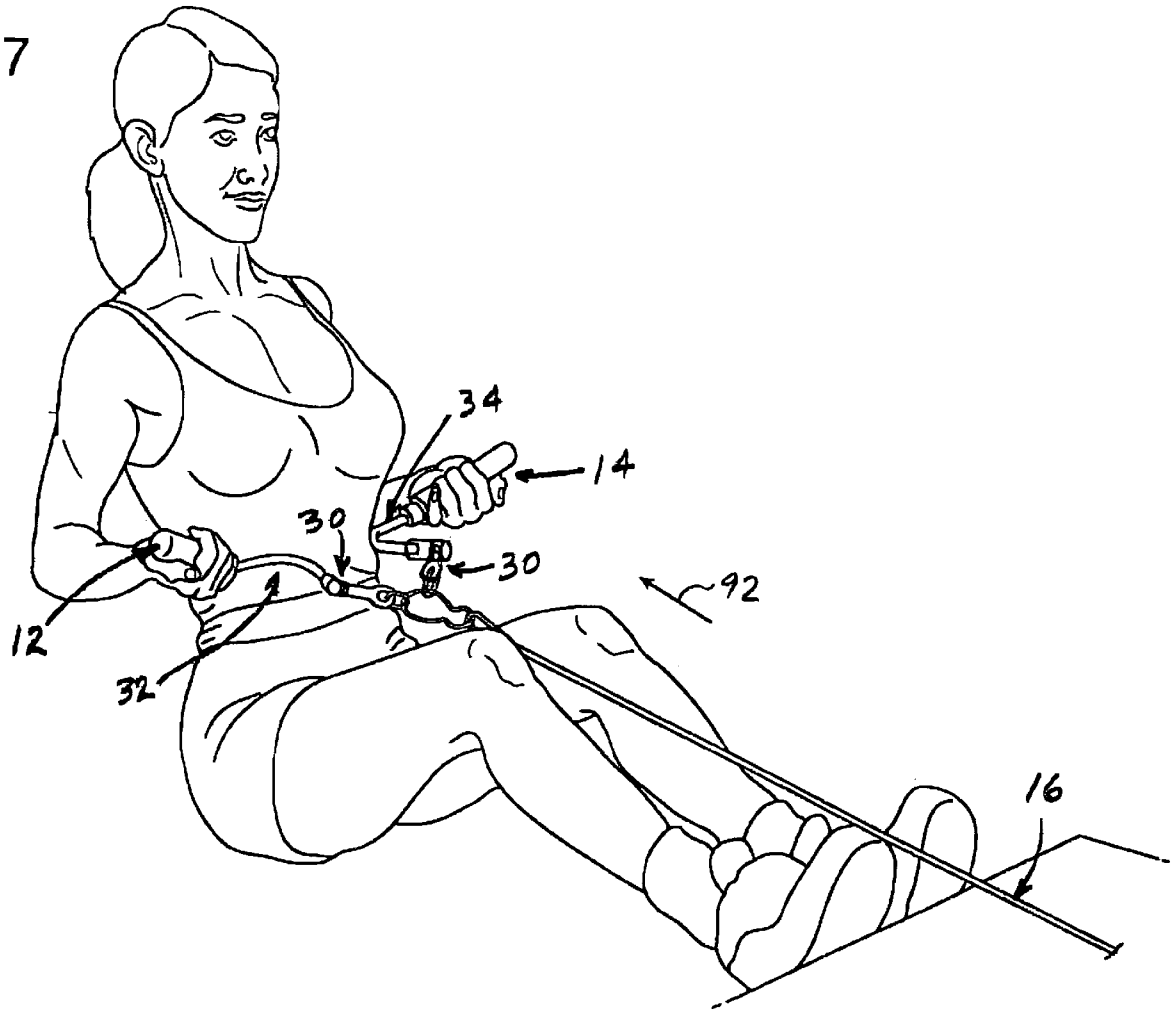
FIG. 17 illustrates the user and the handles shown in FIG. 16 at the culmination of the power stroke in the exercise depicted in FIG. 16.

FIG. 16 illustrates the user 86 performing a seated rowing exercise. In this drawing figure the user 86 is shown grasping the handle 12 in her right hand 87 and the handle 14 in her left hand 89 with her thumbs at the ends of the handgrips 28 remote from the protruding portions 38, 40 and 42 of the bent rods 32 and 34. That is, the user 86 is shown performing the seated rowing exercise in FIG. 16 with the handles 12 positioned relatively to each other in the second basic position which is illustrated FIG. 6. As the user 86 draws rearwardly and exerts a force 92 upon the cable 16 the omnidirectional couplings 30 pivot and the bent rods 32 and 34 rotate within the handgrips 28 so that the force of resistance of the cable 16 remains centered on the user's body even though the handgrips 28 are rotated outwardly, as illustrated in FIG. 17.

Figure 18:
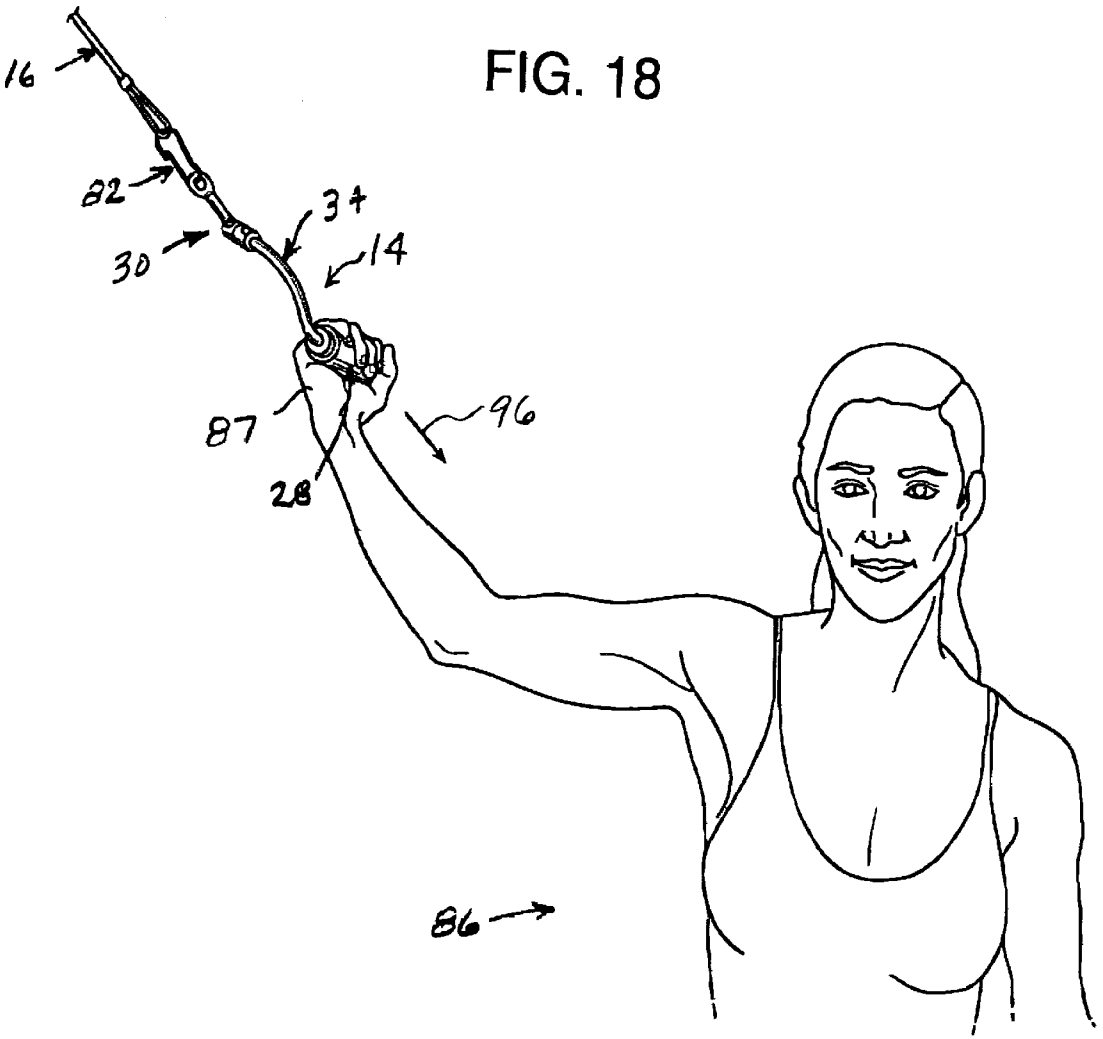
FIG. 18 illustrates the use of the second handle in the pair of handles at the commencement of a power stroke in performing a standing overhead single cable biceps. curl exercise.
Figure 19:
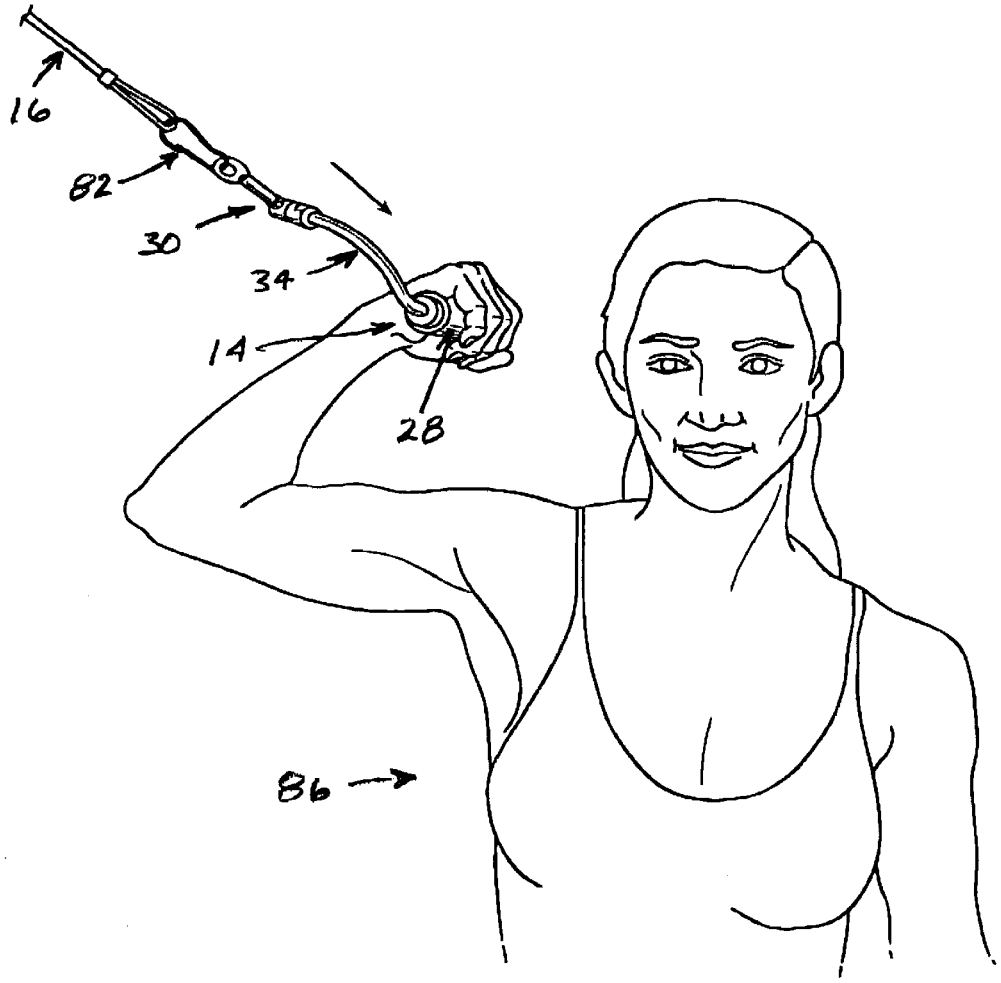
FIG. 19 illustrates the user and the handle of FIG. 18 shown at the culmination of the power stroke of the exercise of FIG. 18.

FIGS. 18 and 19 illustrate the user 86 performing a standing, overhead single cable biceps curl. In this exercise the user 86 is shown employing only the second handle 14 and grasping it in her right hand 87 with her thumb at the butt end of the handle 28 remote from the protruding portions 38, 40 and 42 of the bent rod 34. As the user draws downwardly as indicated by the directional arrow 96, her hand 87 curls in toward her head, as illustrated in FIG. 19. However, the grip attachment portion 36 of the handle 14 freely rotates within the confines of the handle 28 and the components of the omnidirectional cable coupling 30 pivot relative to each other to ensure a smooth, direct, even transmission of force from the cable 16.

Figure 20:
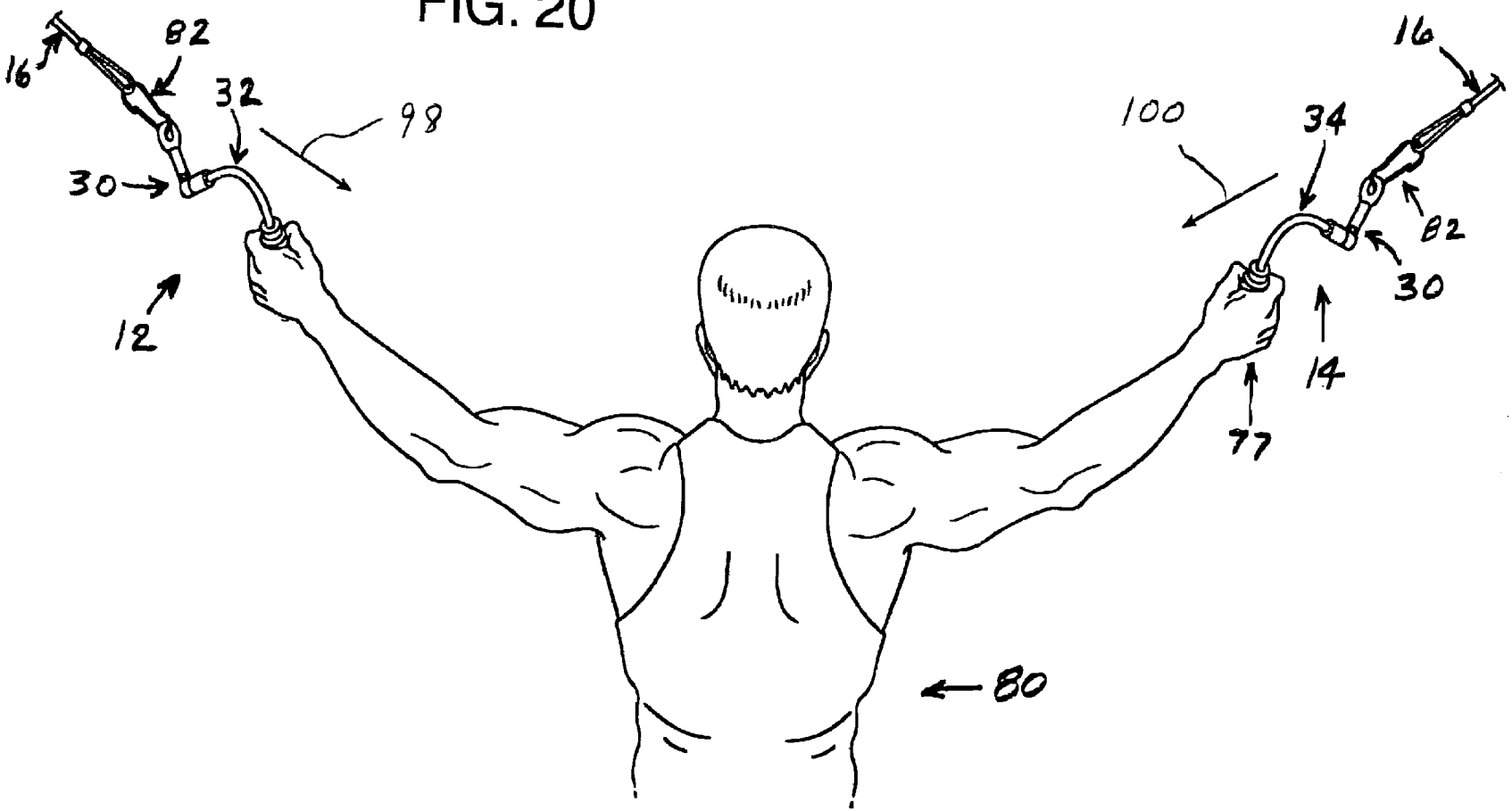
FIG. 20 illustrates a user employing the pair of handles shown in FIG. 1 at the commencement of a power stroke in the performance of a standing overhead double cable biceps curl exercise.
Figure 21:
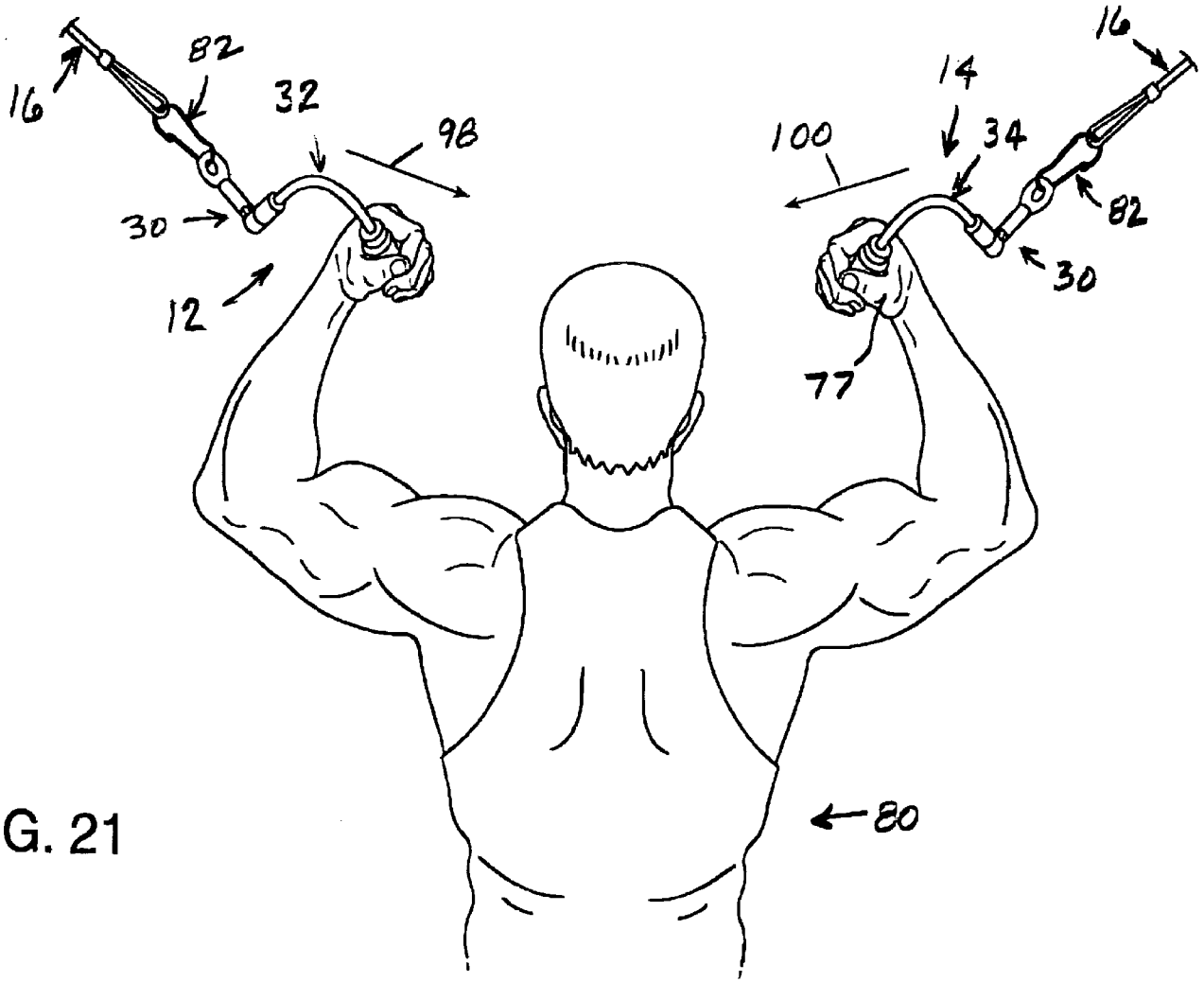
FIG. 21 illustrates the user and the handles shown in FIG. 20 at the culmination of the power stroke of the exercise of FIG. 20.

FIGS. 20 and 21 illustrate the user 80 performing a standing overhead double cable biceps curl exercise. In this exercise the user has grasped the handle 12 in his left hand and the handle 14 in his right hand with his thumbs located next to the protruding portions of the bent steel rods 32 and 34. That is, in the exercise illustrated in drawing FIGS. 20 and 21 the user 80 has gripped the handles 12 and 14 in the third basic position illustrated in FIG. 7.

As the user exerts the forces of his muscles in the directions indicated at 98 and 100, his hands curl in toward his head, as illustrated in FIG. 21. Again, however, the free rotation of the bent rods 32 and 34 relative to the handgrips 28 and the swivel action produced by the omnidirectional couplings 30 in both of the handles 12 and 14 minimize undesirable muscle stresses in performing this exercise.

The drawing figures illustrate only a few of the many different exercises for which the handles 12 and 14 may be employed. Because of their unique configurations, the handles 12 and 14 may be used together in the four different positions described to perform many different lateral and back muscle exercises, abdominal muscle exercises, trice overhead and trice extension exercises, behind the neck overhead trice extensions, shoulder and traps and deltoid exercises, and many other exercises that are performed for physical rehabilitation-and physical fitness purposes.

Undoubtedly, numerous variations and modifications of the invention will become readily apparent to those familiar with muscle exercising and body building equipment. Accordingly, the scope of the invention should not be construed as limited to the specific embodiments depicted and described, but rather is defined in the claims appended hereto.

I claim:

1. A handle for use with a physical exercising machine that has a cable attached to a force-resisting element comprising:

a tubular handgrip of a length and circumference suitable for grasping by the hand of a user, a solid, rigid rod which is configured to form:

a straight, cylindrical grip attachment portion mounted for rotation within said handgrip and constrained from longitudinal movement relative to said handgrip;

a straight, proximal portion located adjacent said grip attachment portion and oriented at a first acute angle of between about fifteen degrees and about forty-five degrees relative to said grip attachment portion, considered in a first plane of reference containing said grip attachment portion, and oriented at a second acute angle of between about twenty degrees and about thirty degrees relative to said grip attachment portion, considered in a second plane of reference containing said grip attachment portion and perpendicular to said first plane of reference, an intermediate curved portion in substantially coplanar relationship with said straight, proximal portion and bent in a curved arc covering more than about sixty degrees and less than about ninety degrees; and a straight distal portion residing in substantially coplanar relationship with said intermediate portion, and a cable coupling mounted for omnidirectional rotational movement relative to said distal portion.

2. A handle according to claim 1 wherein said first acute angle is about twenty-five degrees and said second acute angle is about thirty degrees.

3. A handle according to claim 1 wherein said curved arc is a circular arc of about seventy-five and a half degrees formed at a radius of about one and eight-tenths inches.

4. A handle according to claim 1 wherein said solid, rigid rod is formed of steel and is about three-eighths of an inch in diameter.

5. A handle according to claim 4 wherein said solid rod is formed from a single length of cylindrical stock that is bent to form said first and second acute angles and said arc.

6. A handle according to claim 5 wherein said rod is about eleven and a half inches in overall length.

7. A handle according to claim 5 wherein said handgrip is cylindrical in shape, between about five and a half inches and about seven inches in length, and between about three and a half and about five inches in circumference.

8. A handle according to claim 1 wherein said cable coupling is a ball and socket joint.

9. A handle according to claim 8 wherein said cable coupling includes an end cap on the extremity of said straight distal portion of said rigid rod, and wherein a socket is defined radially into said end cap, and a cable linking stud pin having opposing ends and formed with a ball on one end and a cable connection on the other end, and said ball is permanently set in said socket and is free to pivot relative thereto.

10. A handle according to claim 9 wherein said socket has a radial opening in said end cap that permits said cable linking stud pin to pivot relative thereto through a conical arc of at least about twenty degrees.

11. A pair of handles for use with a body building machine that employs at least one cable attached to a force-resisting element wherein each of said handles is comprised of:

a tubular handgrip of a length and circumference suitable for grasping by the hand of a user, a solid, rigid rod which is configured to form:

a straight, cylindrical grip attachment portion mounted for rotation within said handgrip and constrained from longitudinal movement relative to said handgrip;

a straight, proximal portion located adjacent said grip attachment portion and oriented at a first acute angle of between about fifteen degrees and about forty-five degrees relative to said grip attachment portion, considered in a first plane of reference containing said grip attachment portion, and oriented at a second acute angle of between about twenty degrees and about thirty degrees relative to said grip attachment portion, considered in a second plane of reference containing said grip attachment portion and perpendicular to said first plane of reference;

an intermediate curved portion in substantially coplanar relationship with said straight, proximal portion and bent in a curved arc covering more than about sixty degrees and less than about ninety degrees; and a straight distal portion residing in substantially coplanar relationship with said intermediate portion, and a cable coupling mounted for omnidirectional rotational movement relative to said distal portion and said straight, proximal portions are oriented relative to their respective straight grip attachment portions such that they extend at said second acute angle in opposite directions from each other considered in said second plane of reference.

12. A pair of handles according to claim 11 wherein said first acute angle is about twenty-five degrees, said second acute angle is about thirty degrees, and said arc is a circular arc of about seventy-five and a half degrees formed at a radius of about one and eight-tenths inches in each of said handles.

13. A pair of handles according to claim 12 wherein said straight, proximal portion is about one and a half inches in length, said straight distal portion is about two and two-tenths inches in length, and said rigid rod has a circular cross section about 0.375 inches in diameter.

14. A pair of handles according to claim 12 wherein said cable coupling in each of said handles is formed by an end cap on the extremity of said straight distal portion of said rigid rod, and a socket is defined radially into said end cap, and a cable linking stud pin having opposing ends, and said cable linking stud pin is formed with a ball on one end and a cable connection on the other end, and said ball is permanently captured in said socket, thereby permitting said stud pin to swivel relative to said distal portion of said rigid rod.

15. A pair of handles according to claim 14 wherein said socket defines a radial opening in said end cap that permits said stud pin to swivel through a conical angle of at least about twenty degrees.

16. A pair of handles according to claim 14 wherein said socket defines a radial opening in said end cap that permits said stud pin to swivel through a conical angle of at least about forty degrees.

17. A pair of handles for attachment to a cable connected to a force-resisting member in an exercising apparatus, each handle comprising:

a tubular grip of length and circumference sufficient to accommodate the grasp of the hand of a user, and having a straight, longitudinal, cylindrical opening therewithin, a solid, rigid rod configured to define along its length:

a straight, cylindrical grip attachment portion, delineating a linear axis of grip alignment and mounted for rotation within said cylindrical opening in said grip and restrained from longitudinal movement relative thereto;

a straight, proximal portion inclined relative to said grip attachment portion at a first acute angle considered in a first plane containing said axis of grip alignment and inclined at a second acute angle relative to said grip attachment portion considered in a second plane containing said axis of grip alignment and which is oriented perpendicular to said first plane, and said first acute angle is between about fifteen degrees and about forty-five degrees and said second acute angle is between about twenty degrees and about thirty degrees;

an intermediate portion extending from said straight proximal portion and residing in substantially coplanar relationship therewith, and said intermediate portion is curved in an arc from said straight, proximal portion and in the same direction as said first acute angle considered in said first plane;

a straight, distal portion extending from said intermediate portion and residing in substantially coplanar relationship therewith, wherein said proximal straight portion and said distal, straight portion reside at a third acute angle of greater than about sixty degrees and less than about ninety degrees considered in said first plane; and an omnidirectional coupling is provided on said distal, straight portion, and said second angle at which said straight, proximal portions are oriented relative to their respective grip attachment portions considered in said second plane are in opposite directions from each other.

18. A pair of handles according to claim 17 wherein said first acute angle is about thirty degrees, said second acute angle is about twenty-five degrees, and said arc is a circular arc of about seventy-five and a half degrees formed at a radius of about one and eight-tenths inches in each of said handles, and wherein said straight, proximal portion is about one and a half inches in length, said straight distal portion is about two and two-tenths inches in length, and said rigid rod has a circular cross section about 0.375 inches in diameter.

19. A pair of handles according to claim 17 wherein said cable coupling is a ball and socket joint.

20. A pair of handles according to claim 19 further comprising an end cap on said distal, straight portion of said rod and a radial opening in said end cap into which said ball and socket joint is permanently set.

* * * * *